US007956703B2

(12) United States Patent
Sanders

(10) Patent No.: US 7,956,703 B2
(45) Date of Patent: Jun. 7, 2011

(54) MULTI-BAND TRANSDUCER FOR MULTI-BAND FEED HORN

(75) Inventor: Philip Sanders, Antwerp (BE)

(73) Assignee: Newtec Cy, Sint-Niklaas (BE)

( * ) Notice: Subject to any disclaimer, the term of this patent is extended or adjusted under 35 U.S.C. 154(b) by 172 days.

(21) Appl. No.: 12/162,890

(22) PCT Filed: Jan. 31, 2006

(86) PCT No.: PCT/EP2006/000797

§ 371 (c)(1),
(2), (4) Date: Jul. 31, 2008

(87) PCT Pub. No.: WO2007/087821

PCT Pub. Date: Aug. 9, 2007

(65) Prior Publication Data

US 2009/0027142 A1 Jan. 29, 2009

(51) Int. Cl.
*H01P 1/161* (2006.01)
*H01P 1/213* (2006.01)

(52) U.S. Cl. ..... 333/135; 333/137; 333/21 A; 343/756; 343/776; 343/786

(58) Field of Classification Search ..... 333/21 A, 333/26, 126, 129, 135, 137, 248; 343/756, 343/776, 786

See application file for complete search history.

(56) References Cited

U.S. PATENT DOCUMENTS

| | | | | |
|---|---|---|---|---|
| 5,043,683 | A | 8/1991 | Howard | |
| 5,216,432 | A | 6/1993 | West | |
| 5,331,332 | A | 7/1994 | West | |
| 5,463,407 | A | 10/1995 | West et al. | |
| 5,471,664 | A * | 11/1995 | Kim | 455/323 |
| 5,585,768 | A * | 12/1996 | Wei | 333/137 |
| 5,796,371 | A * | 8/1998 | Sato et al. | 343/786 |
| 6,018,276 | A | 1/2000 | Hirota et al. | |
| 6,081,170 | A | 6/2000 | Enokuma | |
| 6,211,750 | B1 | 4/2001 | Gould | |
| 6,329,957 | B1 | 12/2001 | Shea et al. | |
| 6,906,676 | B2 * | 6/2005 | Killen et al. | 343/786 |
| 2001/0050652 | A1 | 12/2001 | Yoshida et al. | |

FOREIGN PATENT DOCUMENTS

| | | |
|---|---|---|
| EP | 0 350 324 A2 | 1/1990 |
| EP | 0 350 324 A3 | 8/1990 |
| EP | 0 853 348 A2 | 7/1998 |
| EP | 0 853 348 A3 | 10/1998 |
| EP | 1 128 458 A1 | 8/2001 |

OTHER PUBLICATIONS

International Search Report and Written Opinion (PCT/EP2006/000797) mailed Jun. 10, 2006.

Notification Concerning Informal Communications with the Applicant (PCT/EP2006/000797) mailed Feb. 19, 2008.

To the Notification Concerning Informal Communications with the Applicant Dated Feb. 19, 2008 (PCT/EP2006/000797) mailed Mar. 31, 2008.

International Preliminary Report on Patentability (PCT/EP2006/000797) completed Apr. 15, 2008.

Australian Office Action dated Apr. 27, 2010, for Australian Patent Application No. 2006337562.

* cited by examiner

*Primary Examiner* — Benny Lee
(74) *Attorney, Agent, or Firm* — Clark & Elbing LLP

(57) ABSTRACT

A multi-band transducer is described incorporating a coaxial waveguide interface for use with a multi-band feed and incorporating bent shaped probes yielding all-planar interfaces in microstrip for all frequency ranges and suitable for mass production. Hybrids can be incorporated for linear or circular polarization applications.

29 Claims, 24 Drawing Sheets

MULTI-BAND TRANSDUCER FOR MULTI-BAND FEED HORN

CROSS-REFERENCE TO RELATED APPLICATIONS

This application is the U.S. National Stage of International Application No. PCT/EP2006/000797, filed Jan. 31, 2006.

FIELD OF THE INVENTION

This invention relates to a multi-band transducer which can be used as part of a multi-band feed for illuminating a parabolic reflector antenna as well as to methods of manufacture and operation thereof. The multi-band transducer can be a multi-band microwave transducer.

BACKGROUND TO THE INVENTION

Parabolic reflector antennas are widely used for line of sight communication in various frequency bands, such as the Ku and Ka bands. The line of sight (LOS) communication may form part of terrestrial point-to-point communication links, or transmission via communication satellites. It is desirable that a feedhorn should be capable of simultaneously illuminating a parabolic reflector at two frequencies, e.g. the Ku and Ka bands. The antenna beams produced at both frequency bands should be centered along the same boresight axis. This requires the use of a multi-band feed. It should be noted that the term "illuminating" refers to reception and/or transmission of signals.

WO 01/91226 describes a dual-band feed having two circular waveguides mounted coaxially with one another. A high frequency waveguide is mounted coaxially within a lower frequency waveguide. An arrangement of turnstile junctions and connecting waveguides joins the coaxial waveguides to other apparatus.

SUMMARY OF THE INVENTION

An object of the present invention is to provide an improved multi-band transducer which can be used as part of a multi-band feed for illuminating a parabolic reflector antenna as well as to methods of manufacture and operation thereof.

A first aspect of the present invention provides a multi-band transducer for an antenna comprising:

a first waveguide which extends along a longitudinal axis;

a second waveguide which is mounted coaxially with, and around, the first waveguide;

a housing which supports the first and second waveguides and which has an end face which is substantially perpendicular to the longitudinal axis of the waveguides; and at least one second waveguide probe which extends between the interior of the second waveguide and the end face of the housing.

The transducer can also comprises at least one first waveguide probe which extends into the interior of the first waveguide.

Mounting at least one of the probes such that it extends to the end face of the housing has an advantage that the probe or probes can be more easily and cheaply assembled within the housing. The second waveguide probe can be located within individual channels which extend between the end face of the housing and the interior of the second waveguide or a cavity can be provided which serves to guide the probe or probes into position, during assembly. The end face provides a mounting position for a board which can electrically connect to the probe or probes. Support can be provided for microstrip and/or other elements which provide one or more of the functions of connection, impedance matching, amplification, hybrids.

The housing can have at least one funnel-shaped cavity extending between a point at which the at least one second waveguide probe enters the interior of the waveguide and the end face.

Each of the second waveguide probes can be housed within a respective channel within the housing.

Preferably, the second waveguide probes can include a bend, or curved form such that they are inclined with respect to the longitudinal axis of the second waveguide at an end of the probe which enters the interior of the second waveguide, with the inclination being towards the end face of the housing. The second waveguide probes can meet the end face at an angle which is substantially perpendicular to the end face.

In another aspect, the present invention may also provide a dual band, higher and lower frequency range transducer with coaxial and circular waveguide interfaces, a number of probes penetrating into the lower frequency coaxial waveguide and connected, possibly with coaxial line structures, to one or more combiner circuits, possibly on a planar structure perpendicular to the waveguide axis, and a higher frequency range circular waveguide continuing within the lower frequency structure. The probes and combiner circuits together may allow, by suitable design, for a degree of unwanted waveguide mode suppression, e.g. TEM mode in the waveguide for the lower frequency. The continuing higher frequency waveguide may include one or more probes, possibly but not necessarily on the same planar structure as the lower frequency combiner circuits. The dimensioning of the probes and their surrounding structures may allow for impedance matching. The waveguides can be connected, possible with one or more matching device, to a dual band coaxial feed horn. The latter horn and matching devices may form a single piece body with the main body of the transducer.

By extending the same principles, the present invention can also be used to implement a transducer and feed which operate at more than two, e.g. three, bands.

BRIEF DESCRIPTION OF THE DRAWINGS

Embodiments of the invention will be described, by way of example only, with reference to the accompanying drawings, where like features in different drawings are designated by the same reference number and which may not be described in detail in every drawing that they appear, and in which.

DESCRIPTION OF PREFERRED EMBODIMENTS

Figure 1:
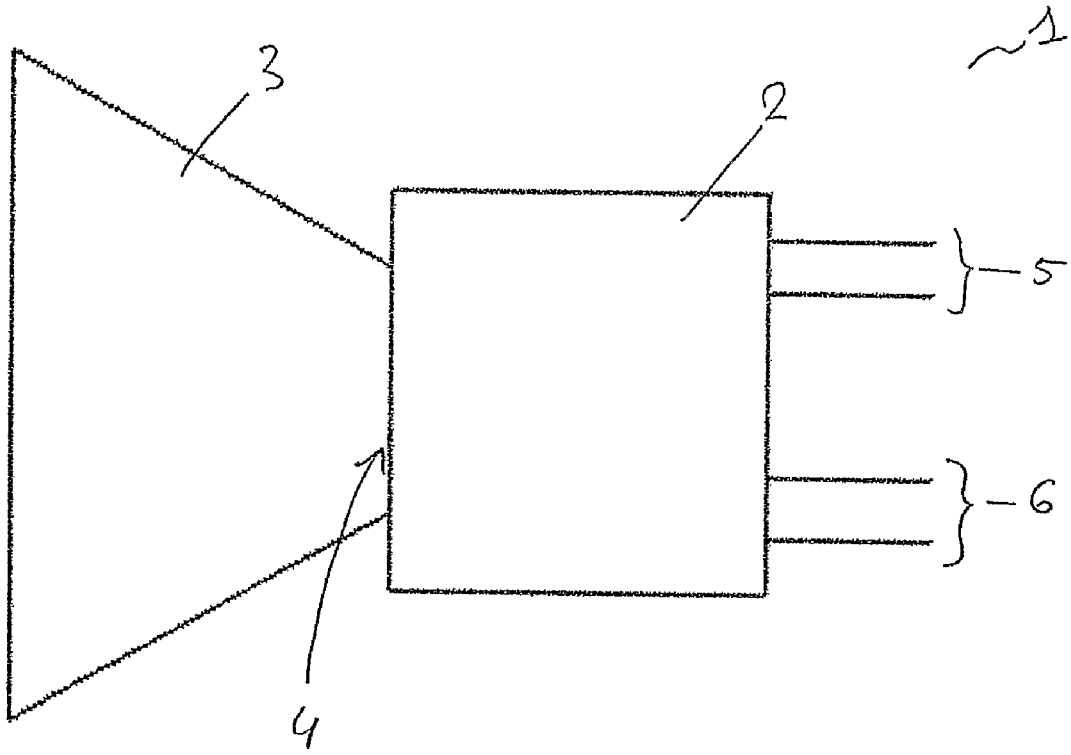
FIG. 1 is a schematic block diagram of a transducer and feed in accordance with an embodiment of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Figure 4:
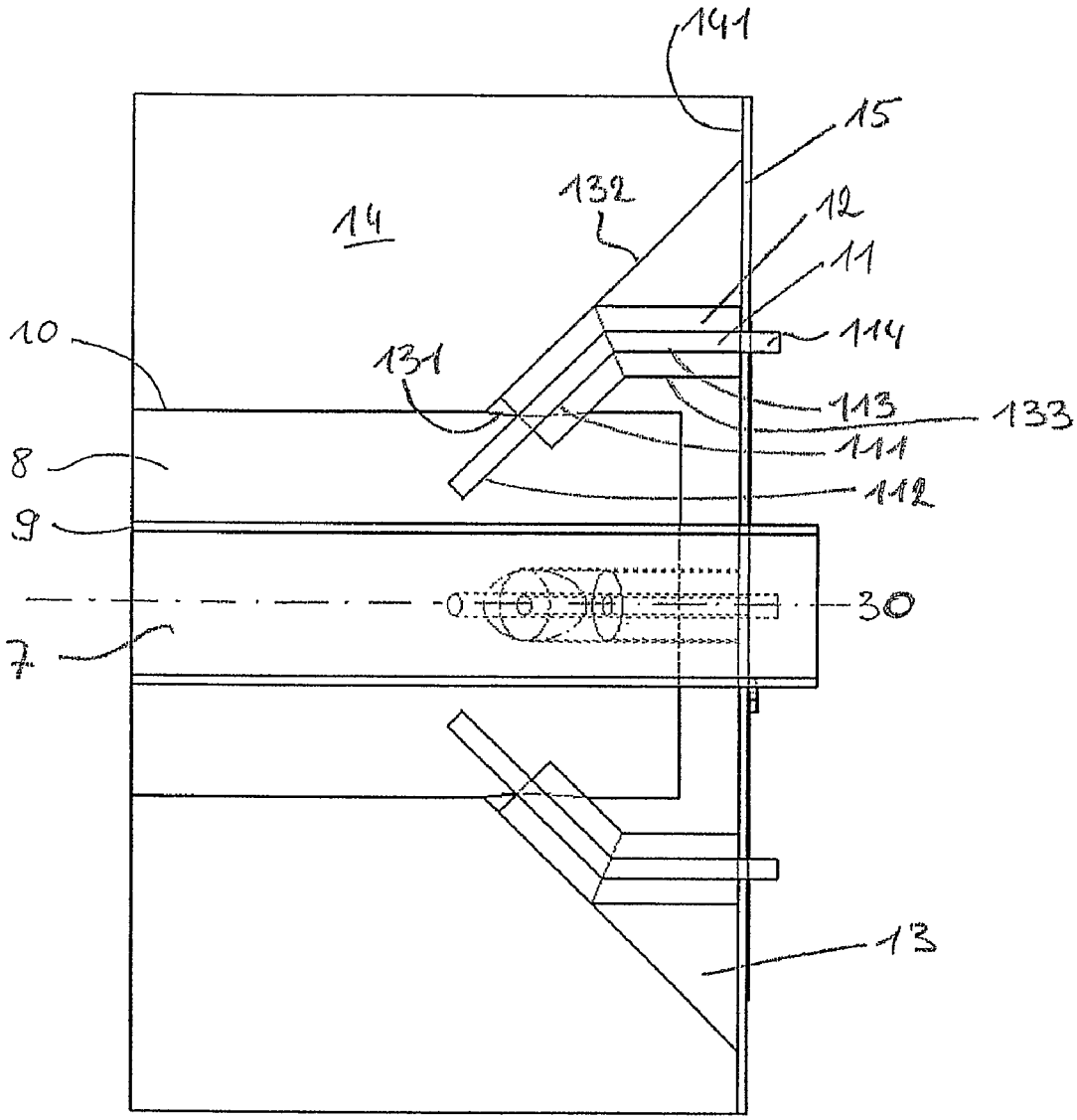
FIG. 4 is a schematic longitudinal section view of an embodiment of the transducer.

FIG. 1 shows a schematic block diagram of a feed 1 for an antenna. The feed 1 includes a transducer 2 and a feed horn 3 that interfaces with the transducer 2 at an interface 4. The transducer 2 in accordance with an embodiment of the present invention has two ports 5 for a lower frequency range, e.g. the Ku band, and a port 6, possibly supporting plural polarization modes for a higher frequency range, e.g. the Ka band. The 'ports' is to be interpreted broadly, e.g. including microstrip transmission lines (as shown in FIG. 4) or waveguides (as shown in FIG. 4 for the higher frequency range), e.g. hollow metallic waveguides, etc. For example various embodiments of the present invention can use different types of ports, e.g. one embodiment uses a waveguide interface, another embodiment uses transitions to micro strip.

The transducer provides isolation between the signals at two frequency bands, for example the Ka and Ku bands, as well as optionally providing isolation between polarizations, e.g. vertical and horizontal or left- and right-hand circular, at each frequency band.

Conventionally, a 'transducer' is something which converts energy from one form to another, such as a probe which converts microwave energy from the waveguide to electrical energy (or vice-versa). The term 'transducer' as used in this invention should be interpreted broadly and also refers to the whole arrangement of probe, waveguides etc.

Figure 2:
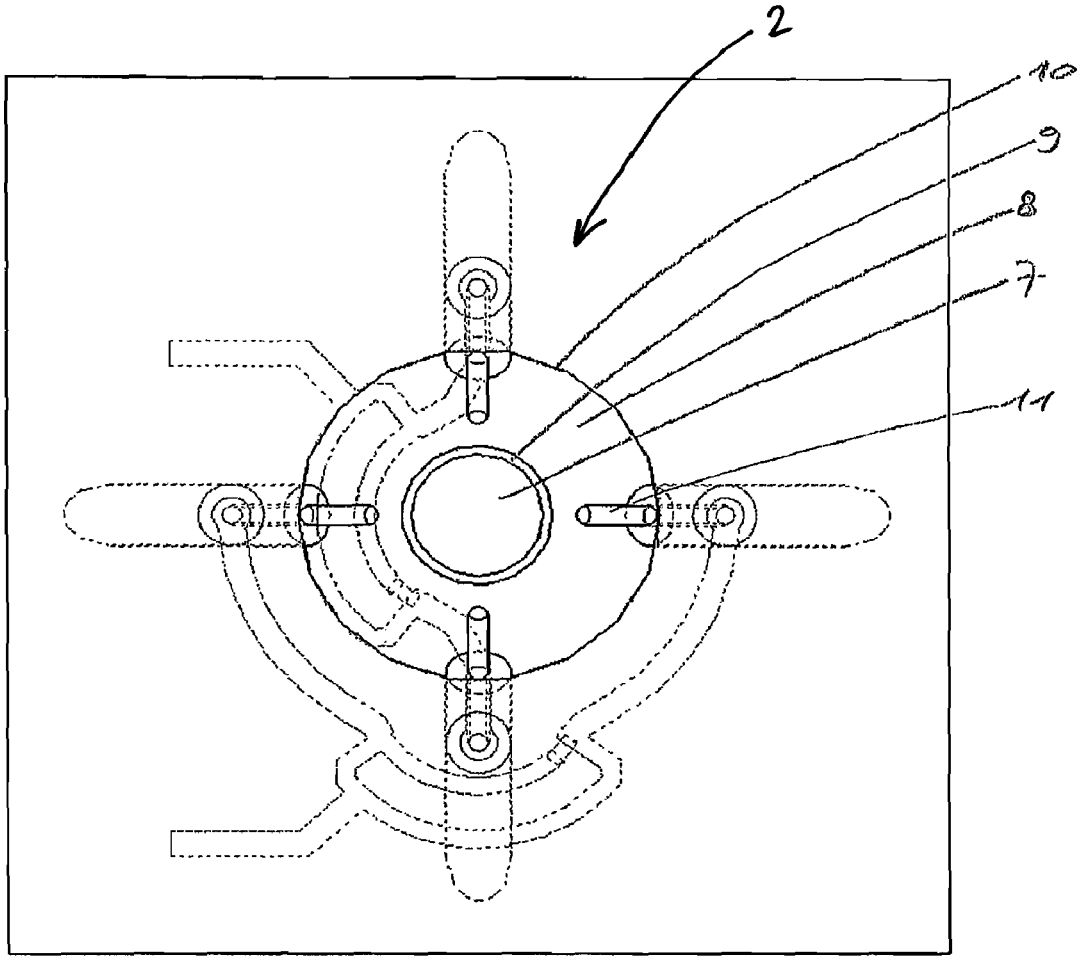
FIG. 2 is a schematic front view of an embodiment of the transducer, looking into the dual band waveguide interfaces.

FIG. 2 shows a schematic front view of the transducer 2, from the direction looking into the interface 4 (FIG. 1). The interface 4 is a coaxial waveguide, with inner circular waveguide section 7 formed by inner region of tube 9, and an outer coaxial waveguide section 8 formed by the outer wall of tube 9 and the wall 10. The inner circular waveguide section 7 is preferably dimensioned such that certain modes, e.g. the TE01 and TE10 modes, can propagate at the higher frequency range of the two frequency ranges, but not at the lower frequency range. The outer coaxial waveguide section 8 is preferably dimensioned such that the same certain modes, e.g. TE01 and TE10 modes can propagate at the lower frequency range. Probes 11 penetrate into the outer coaxial waveguide section 8.

The waveguides are connected, possibly with one or more matching devices, to the dual-band coaxial feed horn 3. The feed horn 3 and matching devices may form a single piece body with the main body of the transducer 2.

Figure 3:
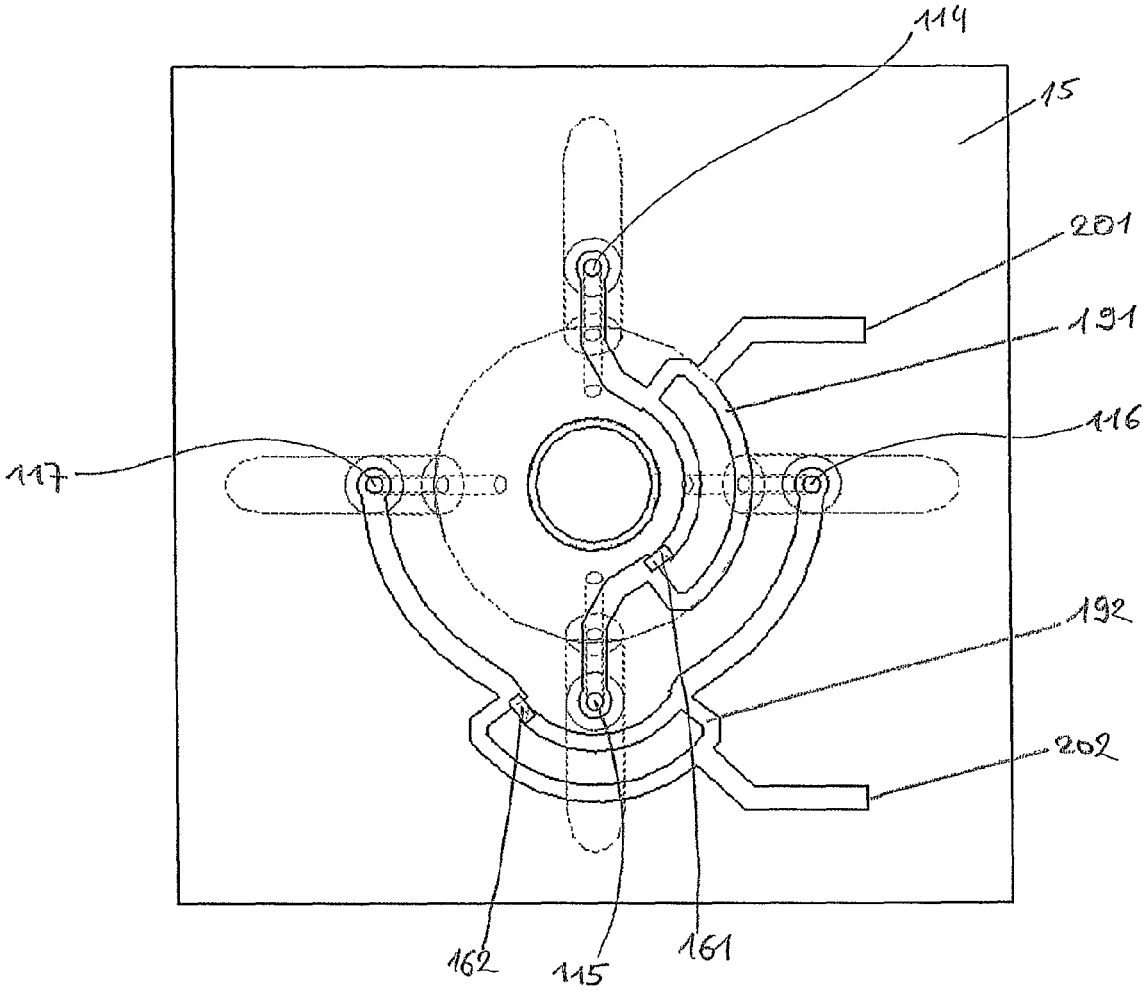
FIG. 3 is a schematic rear view of an embodiment of the transducer.

FIGS. 3 and 4 are schematic rear view and a schematic longitudinal section view, respectively, of the transducer 2. In this embodiment four probes 11 (FIG. 4) penetrate into the outer coaxial waveguide section 8 and provide electrical coupling to the TE01 and TE10 modes. As shown in FIG. 4, the probes 11 preferably are bent. Each probe 11 has a first portion 111 which is inclined with respect to the longitudinal axis 30 of the waveguides, the inclination being towards the end face 141 of the housing 14. A tip 112 of each probe 11 protrudes into the waveguide 8.

Figure 15:
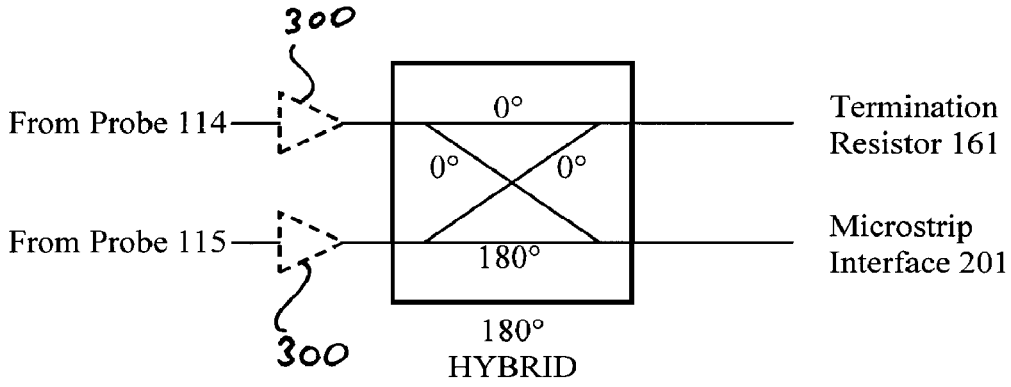
FIG. 15 is a simplified electrical schematic of embodiments of the present invention for hybrid circuits for linear polarization applications (degree indicators, such as (0°, 180°), signify phase offsets between linked elements)

A second portion 113 of each probe 11 is aligned substantially parallel with the longitudinal axis 30 of the waveguides. Each probe 11 preferably has some dielectric material 12 surrounding the probe 11. This helps to position the probe 11 correctly. A board 15 is mounted to the end face 141 of the housing 14, perpendicular to the longitudinal axis 30 of the waveguides. The board can be secured to the housing by any suitable mounting technique. This board can secured to the main body, for example, by, but not limited to, the use of fixation screws, glue or sandwiched with an additional cover. As shown in FIG. 3, tips 114, 115, 116 and 117 of the probes 11 connect to the board 15. Two combiner circuits 191, 192 are implemented on the board 15 as microstrip elements. Each combiner circuit 191, 192 connects an opposing pair of probes. Each combiner circuit 191, 192 has a respective microstrip interface 201, 202 for that polarization. Each combiner circuit implements an approximately differential combination, i.e. approximately 180° relative phase difference, of the two signals derived from the pair of probes. Each combiner circuit preferably also provides some degree of termination for the sum signal with the resistors 161 and 162, that is the hybrid ideally implements a 180° sum-delta hybrid, as shown in FIG. 15 having inputs from the probes 114 and 115, respectively, the output 201 and the termination resistor 161, output 201 being at a microstrip interface. Hence, using matrix notation for the transfer functions, the operation with an idealized hybrid is given by, but ignoring common phase offsets:

$$\begin{pmatrix} \text{Output201} \\ \text{Res161} \end{pmatrix} = \begin{pmatrix} \sqrt{0.5} & -\sqrt{0.5} \\ \sqrt{0.5} & \sqrt{0.5} \end{pmatrix} \cdot \begin{pmatrix} \text{Probe114} \\ \text{Probe115} \end{pmatrix}$$

Because each pair of connected probes are oppositely oriented in the waveguide, they have opposite phase coupling to the parallel oriented TE01 mode, and hence their signals, after the 180° shift provided by the combining circuit 191, combine approximately in phase at the combiner output 201. Also, because the probes preferably do not couple to the orthogonal TE10 mode, an amount of cross-polar isolation can be obtained, even with non-ideal combiner circuits. The probes 114 and 115 ideally have in-phase coupling with the TEM mode of the coaxial waveguide and hence, because of the combiner circuit phase relation, the TEM mode is to some extent coupled to the 0° sum signal port terminated with termination resistor 161, whereas the contribution to the output 201 is effectively cancelled due to the 180° shift. Hence, the TEM mode is to some degree, coupled to the termination resistor 161, and therefore some degree of termination is provided. This helps to reduce parasitic resonances in the TEM mode of the coaxial waveguide. Again using matrix notation, the idealized operation can be summarized as follows, but ignoring common phase offsets:

$$\begin{pmatrix} \text{Probe114} \\ \text{Probe115} \end{pmatrix} = \begin{pmatrix} \sqrt{0.5} & a\sqrt{0.5} \\ -\sqrt{0.5} & a\sqrt{0.5} \end{pmatrix} \cdot \begin{pmatrix} TE01 \\ TEM \end{pmatrix} \text{ where } |a| < 1.$$

Together with the idealized hybrid transfer matrix shown before, we obtain:

$$\begin{pmatrix} \text{Port201} \\ \text{Res161} \end{pmatrix} = \begin{pmatrix} 1 & 0 \\ 0 & a \end{pmatrix} \cdot \begin{pmatrix} TE01 \\ TEM \end{pmatrix}$$

Similarly for Port202, we obtain:

$$\begin{pmatrix} \text{Port202} \\ \text{Res162} \end{pmatrix} = \begin{pmatrix} 1 & 0 \\ 0 & a \end{pmatrix} \cdot \begin{pmatrix} TE10 \\ TEM \end{pmatrix}$$

Figure 5:
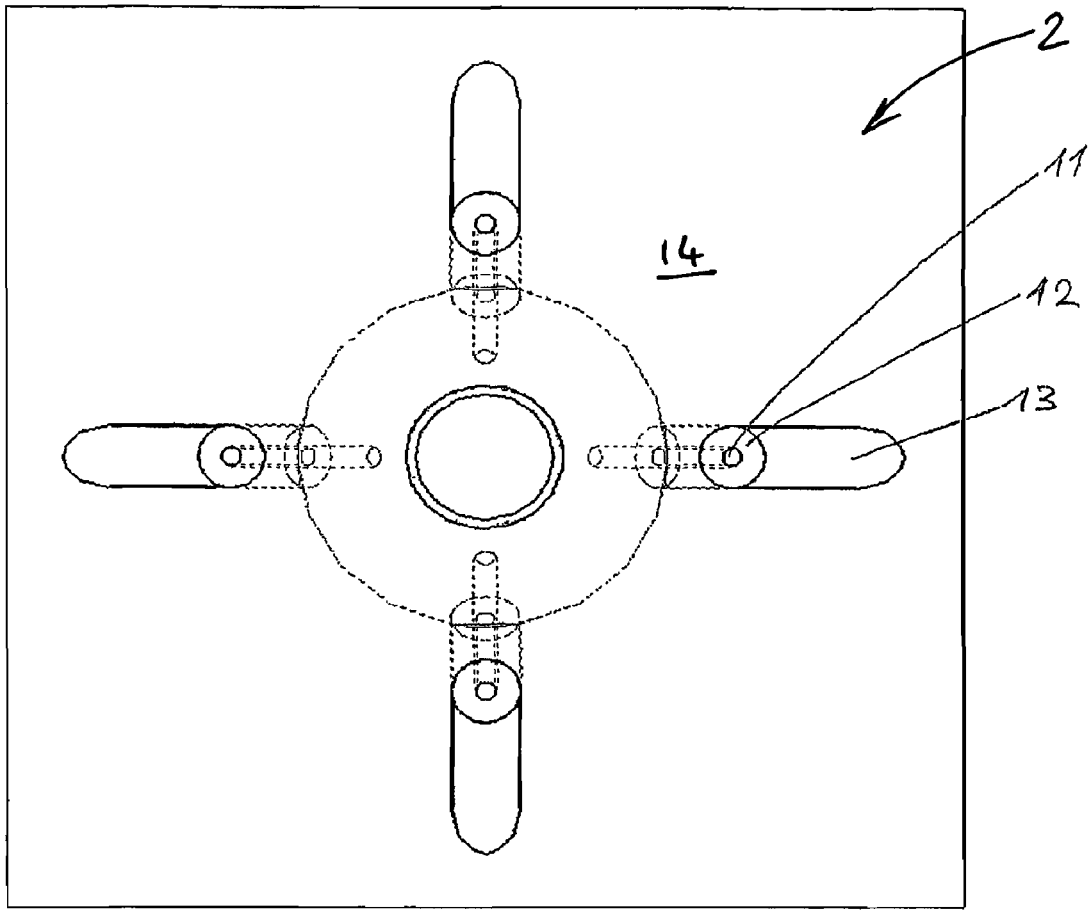
FIG. 5 is a schematic rear view of an embodiment of the transducer, with the planar lower frequency combiner circuits removed for illustrative purpose, thus showing an embodiment of a mechanical inner construction.

FIG. 5 is a schematic rear view of the embodiment of the transducer 2, with the planar lower frequency combiner circuit removed for clarity. The main housing has a set of appropriately shaped cavities 13, which will also be called channels 13. The channels 13 allow the probes 11 and their dielectric surrounding 12 to be inserted into position during the manufacturing assembly process. This is possible, even when the main housing 14 is made of a single part preferably suitable for mass manufacturing, for example, suitable manufacturing or fabrication techniques such as, but not limited to, metal molding or plastic molding with metallic coating. As shown in FIG. 5, each channel 13 is located where a probe needs to be positioned in the waveguide and extends radially from an entry position to the waveguide (131 shown in FIG. 4) to the end face 141. During assembly the channel 13 serves to guide the probe into position. The diameter of the channel, at the end nearest waveguide 8, is equal to, or just greater than that of the probe 11 and dielectric shroud 12 such that the probe 11 is supported by a frictional fit in the required position, or is held in place due to the shape of the cavity and the presence of the board 15 and/or the preferably solder connection to the microstrip on board 15.

Referring again to FIG. 4, each channel 13 is generally funnel-shaped. The radially outermost wall 132 of the channel 13 is aligned with portion 111 of the probe and extends between the wall of waveguide 8 and the end face 141 of the housing 14. The radially innermost wall 133 of the channel 13 has a dog-leg shape, with a first part extending from the wall 10 of the waveguide 8 at an angle inclined with respect to axis 30. This first part is spaced from, and parallel to, the radially-outermost side 132. A second part of the wall 133 extends parallel with axis 30 and meets the end face 141. During assembly, a non-straight or bent-shaped probe 11 is inserted into a respective channel 13 at an angle which is inclined with respect to the longitudinal axis 30. The probe slides along wall 132 of the channel 13. The probe is stopped when the dielectric shrouds 12 touches wall 133, thereby defining the amount the tip 112 extends into the waveguide 8. At this point, the probe part 113 between the bent and probe end 114 is substantially perpendicular to the end face 141 and parallel with the longitudinal axis 30 of the waveguides. The board 15 is then mounted to end face 141 of the housing and probe tips 114 are soldered to the board 15.

The dimensions of the channel 13, probes 11 and their dielectric shrouds 12 can be optimized, for example with, but not limited to, electromagnetic 3D simulation software, to provide impedance transformation.

Figure 6:
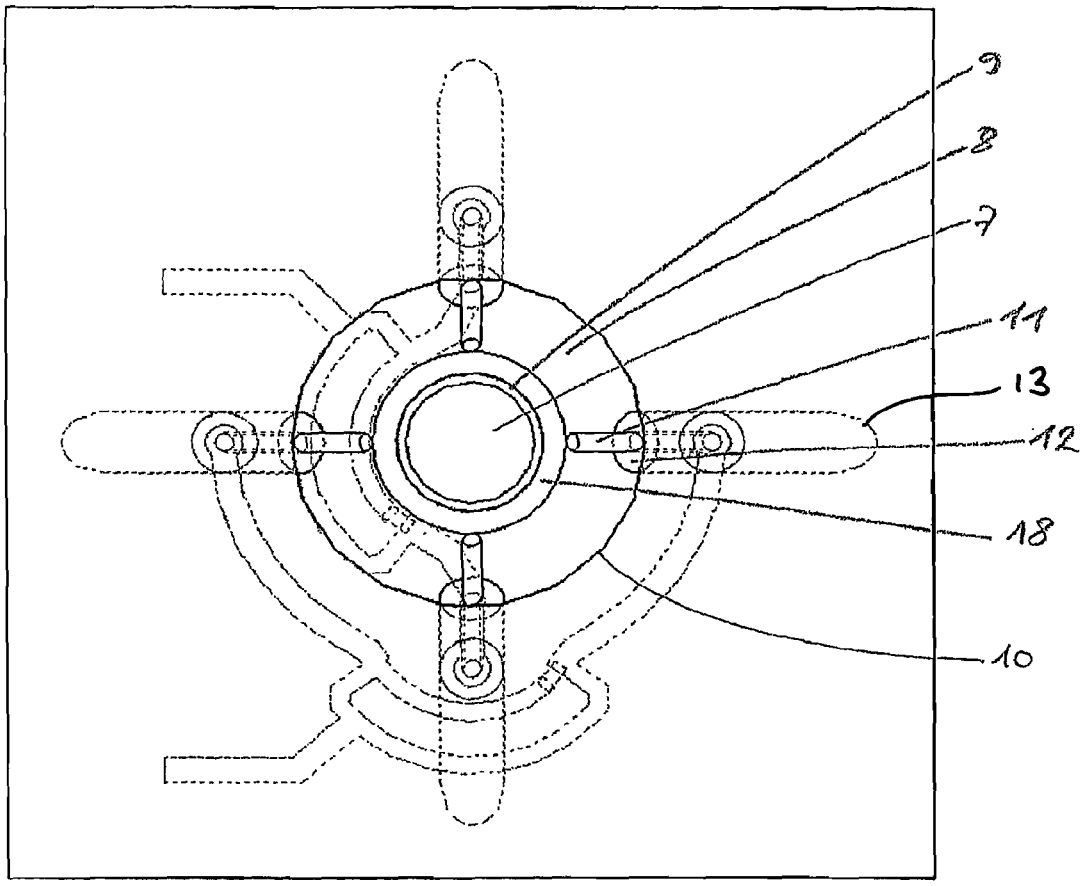
FIG. 6 and FIG. 7 are a schematic front view and a schematic longitudinal section view, respectively, of the embodiment of a transducer including an additional, preferably dielectric, structure in the coaxial waveguide as to improve alignment tolerances of the probes.
Figure 7:
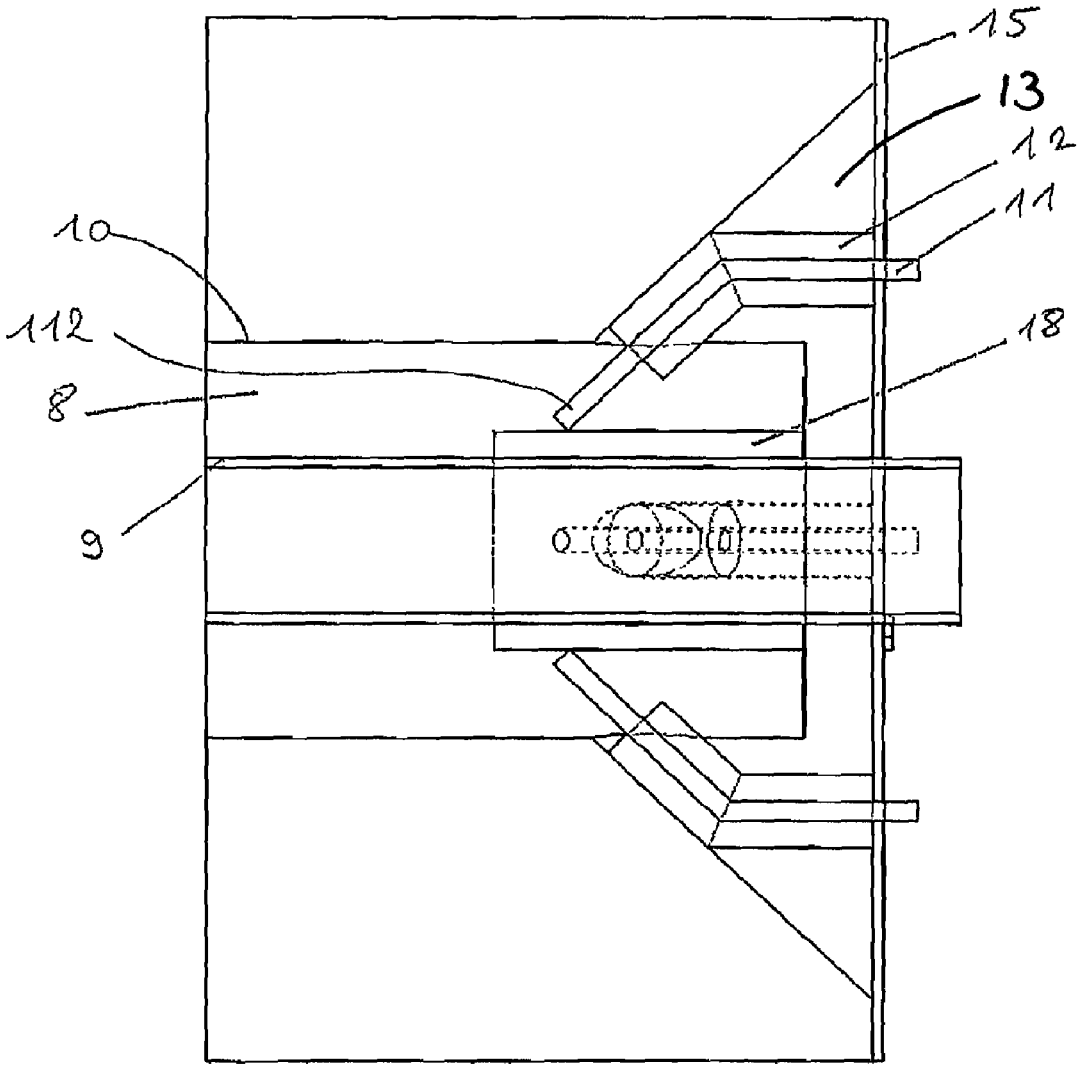

FIGS. 6-9 show two further embodiments of the invention in which improvements are made to aid in the positioning of probes within the waveguide. Firstly, FIG. 6 and FIG. 7 are a schematic front view and a schematic longitudinal section view, respectively, of an embodiment of a transducer which includes an additional element 18 positioned in the outer coaxial waveguide section 8. Structure 18 is preferably dielectric material and helps to improve alignment tolerances of the probes 11. The element 18 surrounds the inner waveguide tube 9 and allows a mechanical positioning of the probes 11, thus reducing the tolerances on the position of the probes relative to the waveguide 8, and improving mass manufacturing repeatability. The assembly process is the same as described above. However, the probe 11 can now be more reliably positioned within waveguide 8 as probe 11 can be inserted into a respective channel 13 until probe tip 112 (FIG. 7) reaches the radially-outermost surface of element 18.

Figure 8:
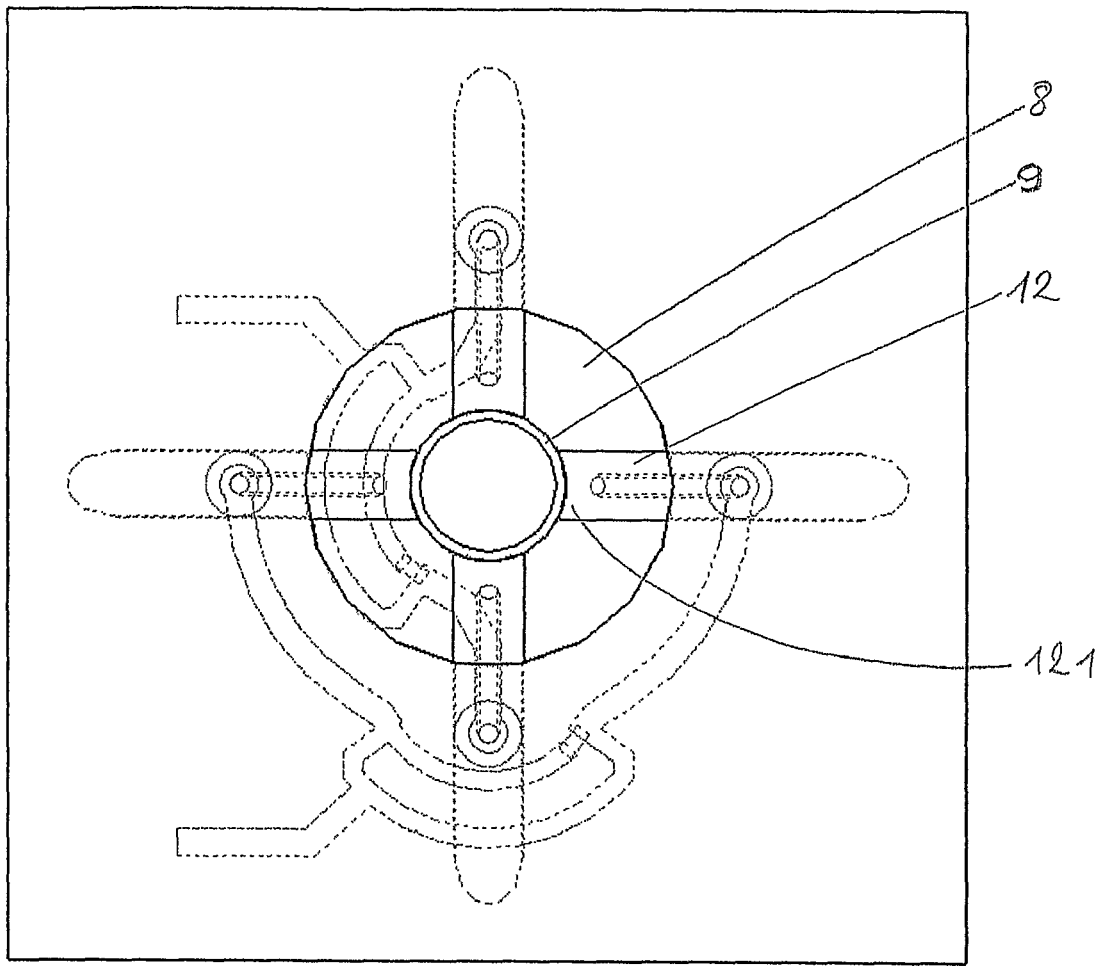
FIG. 8 and FIG. 9 are a schematic front view and a schematic longitudinal section view, respectively, of the embodiment of a transducer including probes with extended dielectric to improve alignment tolerances.
Figure 9:
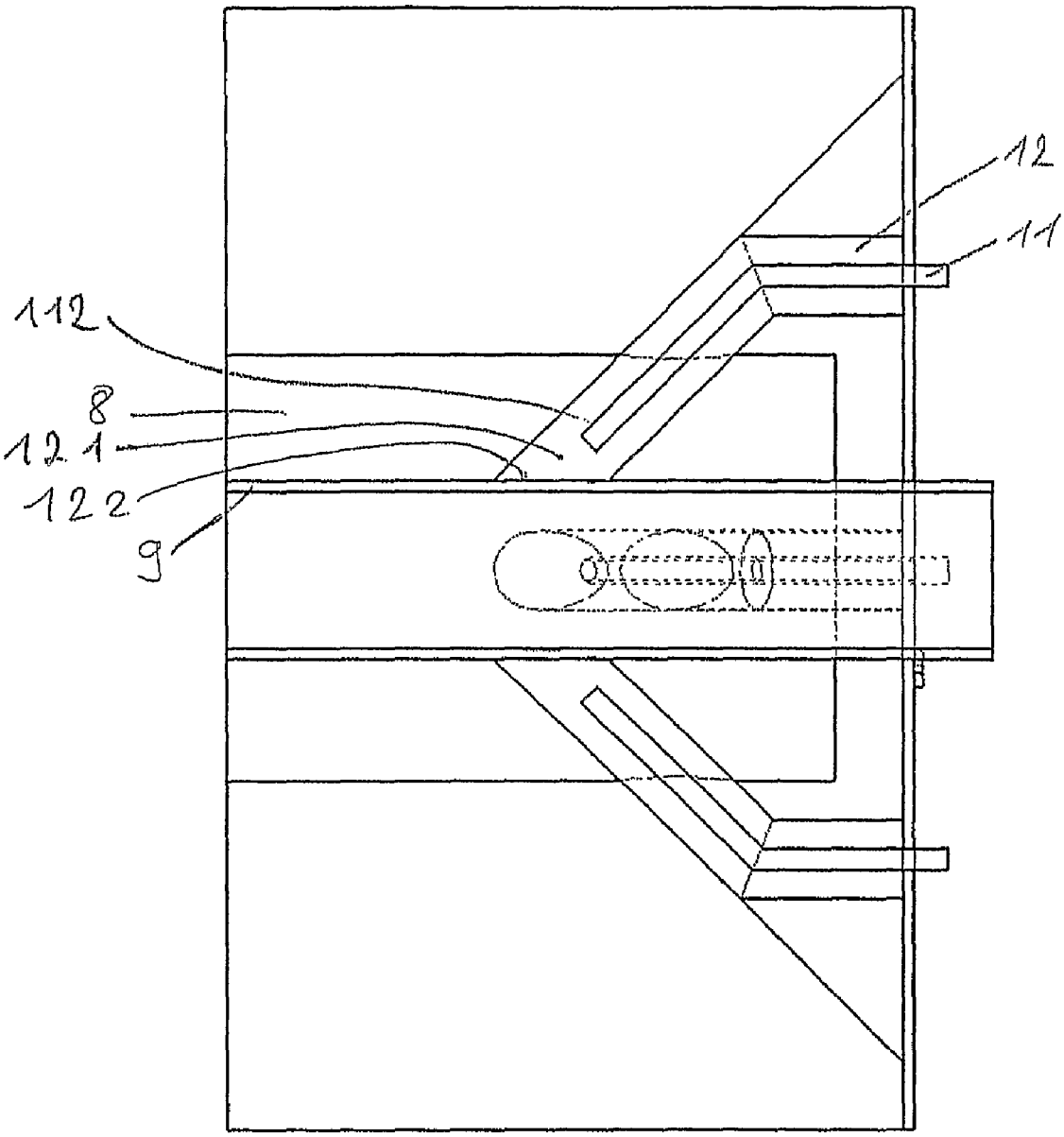

FIG. 8 and FIG. 9 are a schematic front view and a schematic longitudinal section view, respectively, of an embodiment of a transducer including probes 11 (FIG. 9) with extended dielectric shrouding material 12 to improve alignment tolerances. The dielectric shrouding material 12 around the probe 11 (FIG. 9) is extended past the end of the probe tip 112 (FIG. 9) so that it mechanically touches the inner waveguide tube 9. This allows the probe tip 112 (FIG. 9) to be positioned at the required depth inside waveguide section 8. This reduces the tolerances on the position of the probes 11 relative to the waveguide 8 and improves mass manufacturing repeatability. The dielectric 121 (FIGS. 8 and 9) has a face 122 (FIG. 9) suitably shaped such that it presses across its, preferably, but not necessarily, full face against wall 9. It is not essential to provide this inclined face on the dielectric material; for example the dielectric could be cut in other ways or shapes but the penetration depth of the probe tip 112 is an electrical design parameter and should preferably not lead to a free end in case of a perpendicular dielectric end. The design as shown and described will provide close tolerances.

Figure 16:
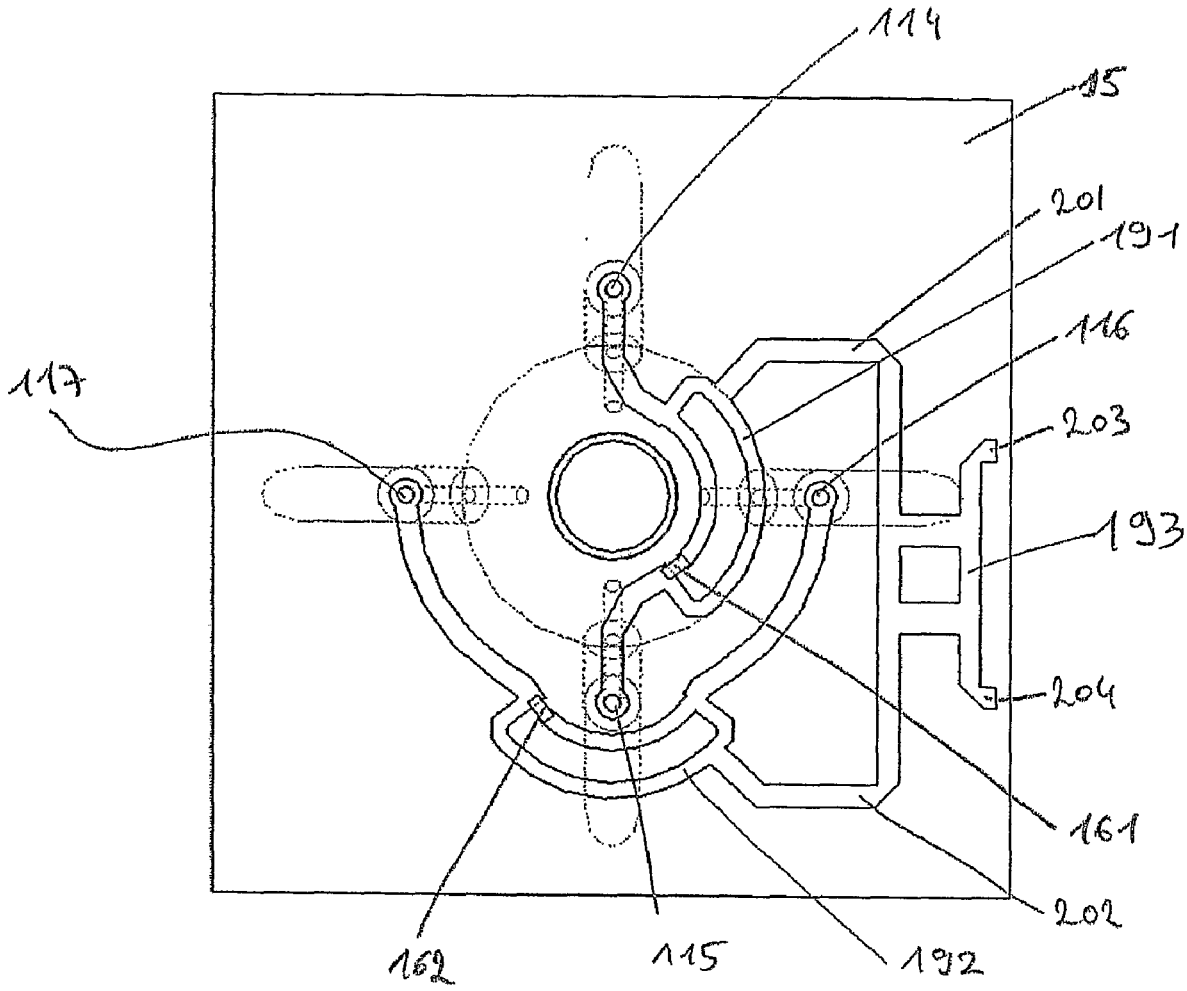
FIG. 16 is a schematic rear view of an embodiment of the transducer with hybrid circuit extended for circular polarization applications.
Figure 17:
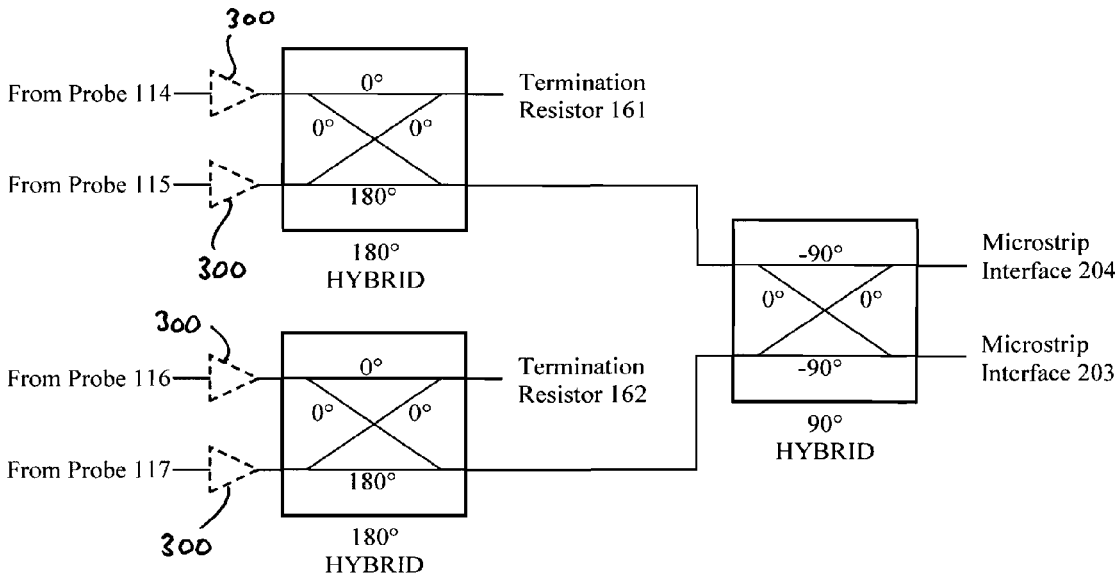
FIG. 17 is a simplified electrical schematic of this embodiment (degree indicators, such as (0°, −90°, 180°), signify phase offsets between linked elements)

FIG. 16 is a schematic rear view of an embodiment of the transducer with hybrid circuit extended for circular polarization having ports 201, 202, 203, and 204 and termination resistors 161 and 162; the idealized electrical schematic is shown in FIG. 17 in which the ports 203 and 204 are at microstrip interfaces, respectively. A preferably 90° hybrid is cascaded to the 180° hybrids, as depicted in FIG. 17. Using matrix notation, the idealized operation can be summarized as follows: In the waveguide, we have for the linear and circular modes:

$$\begin{pmatrix} TE01 \\ TE10 \end{pmatrix} = \begin{pmatrix} \sqrt{0.5} & j\sqrt{0.5} \\ j\sqrt{0.5} & \sqrt{0.5} \end{pmatrix} \cdot \begin{pmatrix} LeftCircular \\ RightCircular \end{pmatrix}$$

where:

j is the imaginary unit of the complex number system;

LeftCircular is the field value of the left hand circular polarized mode in the waveguide;

RightCircular is the field value of the right hand circular polarized mode in the waveguide.

For the idealized 90° hybrid we obtain:

$$\begin{pmatrix} \text{Port203} \\ \text{Port204} \end{pmatrix} = \begin{pmatrix} \sqrt{0.5} & -j\sqrt{0.5} \\ -j\sqrt{0.5} & \sqrt{0.5} \end{pmatrix} \cdot \begin{pmatrix} \text{Port201} \\ \text{Port202} \end{pmatrix}$$

Together with the relations described above for the linear polarization embodiment, we obtain:

$$\begin{pmatrix} \text{Port203} \\ \text{Port204} \\ \text{Res161} \\ \text{Res162} \end{pmatrix} = \begin{pmatrix} 0.5 & -0.5 & -0.5j & 0.5j \\ -0.5j & 0.5j & 0.5 & -0.5 \\ \sqrt{0.5} & \sqrt{0.5} & 0 & 0 \\ 0 & 0 & \sqrt{0.5} & \sqrt{0.5} \end{pmatrix} \cdot \begin{pmatrix} \text{Probe114} \\ \text{Probe115} \\ \text{Probe116} \\ \text{Probe117} \end{pmatrix} \quad \text{(Equation 1)}$$

and therefore:

$$\begin{pmatrix} \text{Port203} \\ \text{Port204} \\ \text{Res161} \\ \text{Res162} \end{pmatrix} = \begin{pmatrix} 1 & 0 & 0 \\ 0 & 1 & 0 \\ 0 & 0 & a\sqrt{0.5} \\ 0 & 0 & a\sqrt{0.5} \end{pmatrix} \cdot \begin{pmatrix} LeftCircular \\ RightCircular \\ TEM \end{pmatrix}$$

Alternatively, the overall same functionality can be implemented in a hybrid, or set of hybrids, with the 4 probes connected to 4 inputs, and with, one or two outputs, one output for each circular polarization (i.e. left-hand circular or/and right-hand circular) and providing similar relationships as expressed above in equation 1, or part thereof. Also, by appropriate design of the hybrid, one or more resistors may be incorporated as to provide some degree of termination of the coaxial waveguide TEM mode.

Figure 18:
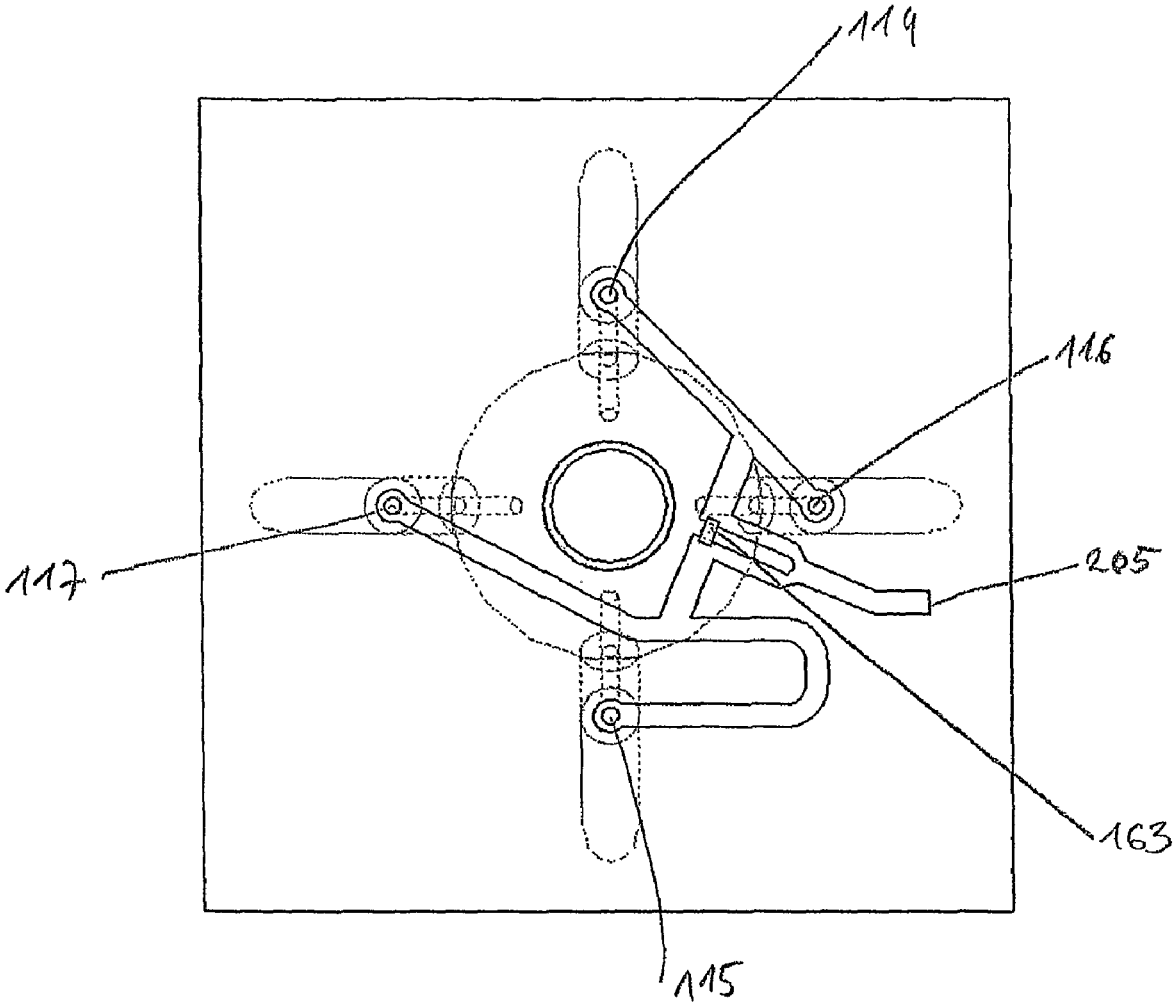
FIG. 18 is a schematic rear view of an alternative embodiment of the transducer with hybrid circuit extended for circular polarization applications.
Figure 19:
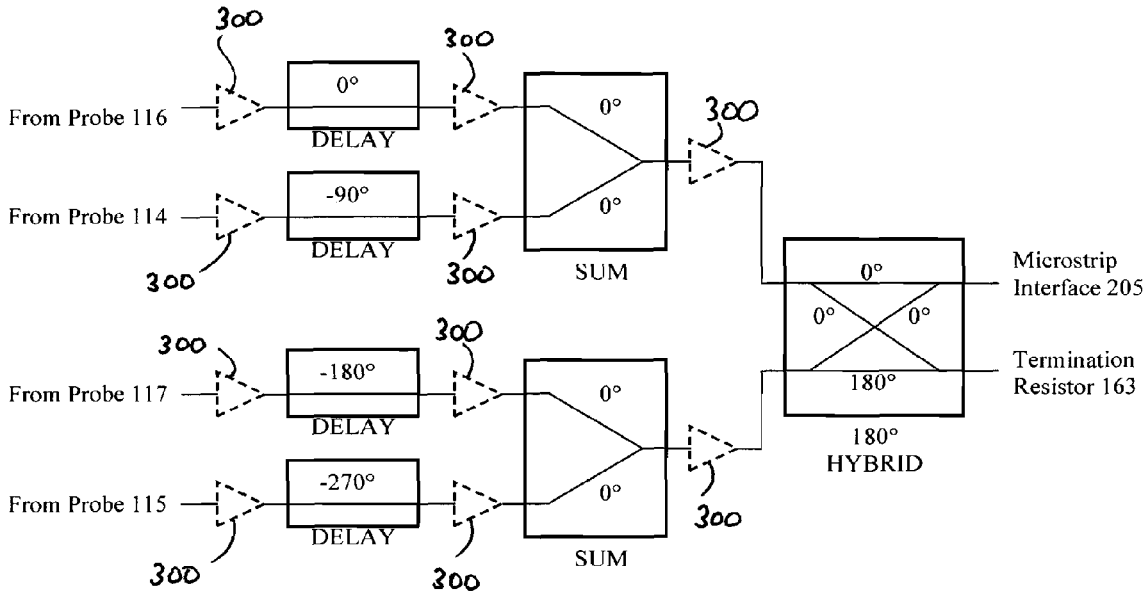
FIG. 19 is a simplified electrical schematic of this embodiment (degree indicators, such as (0°, −90°, ±180°, −270°), signify phase offsets between linked elements), including delay circuits which impart the depicted phase offset.

FIG. 18 is a schematic rear view of an embodiment of the transducer with an alternative hybrid circuit with a single output 205 for circular polarization and incorporating a termination resistor 163. The idealized electrical schematic is shown in FIG. 19, having inputs from probe 114, 115, 116, and 117, respectively, and port 205 at a microstrip interface and termination resistor 163. The idealized operation is described by the following, but ignoring common phase offsets:

$$\begin{pmatrix} \text{Port205} \\ \text{Res163} \end{pmatrix} = \begin{pmatrix} 0.5 & -0.5 & j0.5 & -j0.5 \\ a\cdot 0.5 & a\cdot 0.5 & a\cdot 0.5 & a\cdot 0.5 \end{pmatrix} \cdot \begin{pmatrix} \text{Probe114} \\ \text{Probe115} \\ \text{Probe116} \\ \text{Probe117} \end{pmatrix}$$

and therefore:

$$\begin{pmatrix} \text{Port205} \\ \text{Res163} \end{pmatrix} = \begin{pmatrix} 1 & 0 & 0 \\ 0 & 0 & a \end{pmatrix} \cdot \begin{pmatrix} LeftCircular \\ RightCircular \\ TEM \end{pmatrix}$$

Figure 20:
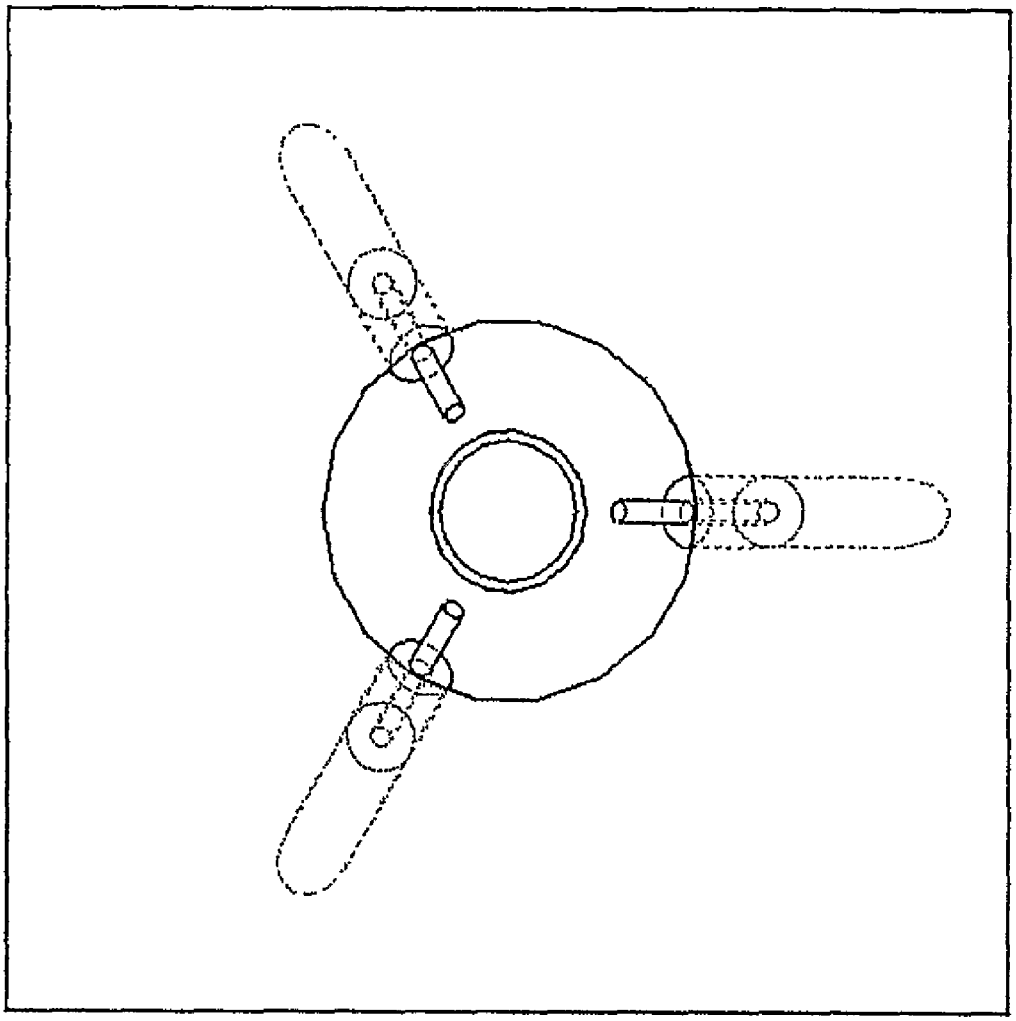
FIG. 20 and FIG. 21 are a schematic front view looking into the dual band waveguide interfaces and a schematic rear view, respectively, of an embodiment of the transducer using 3 probes.
Figure 21:
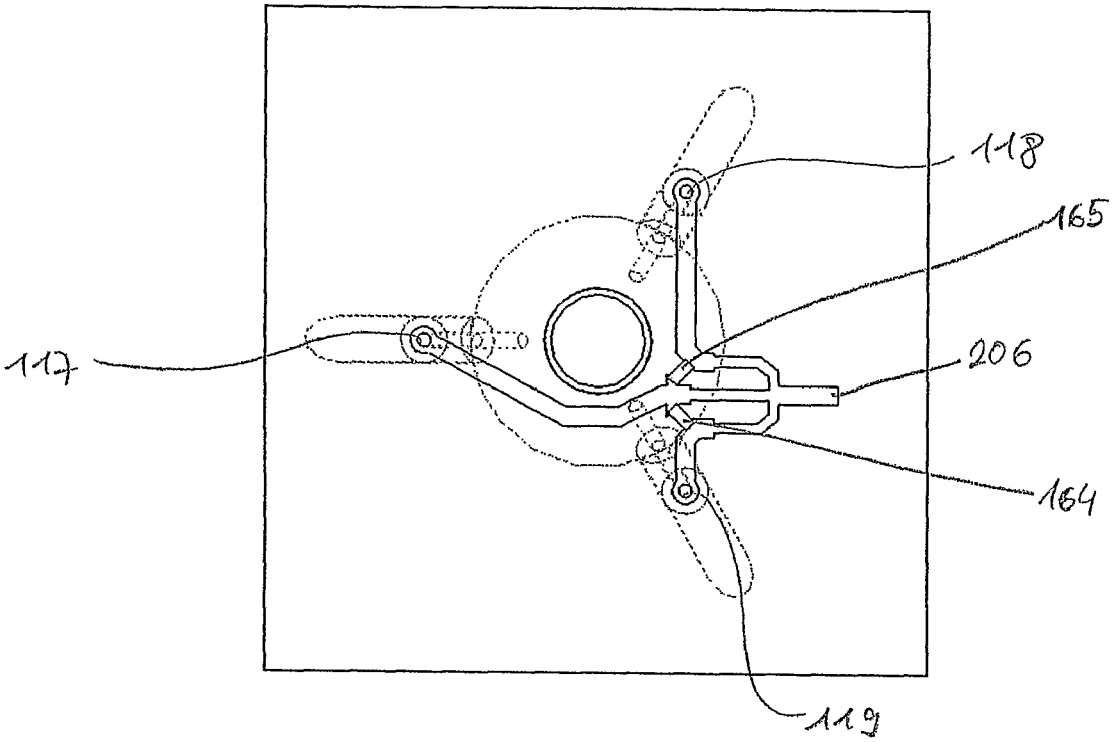
Figure 22:
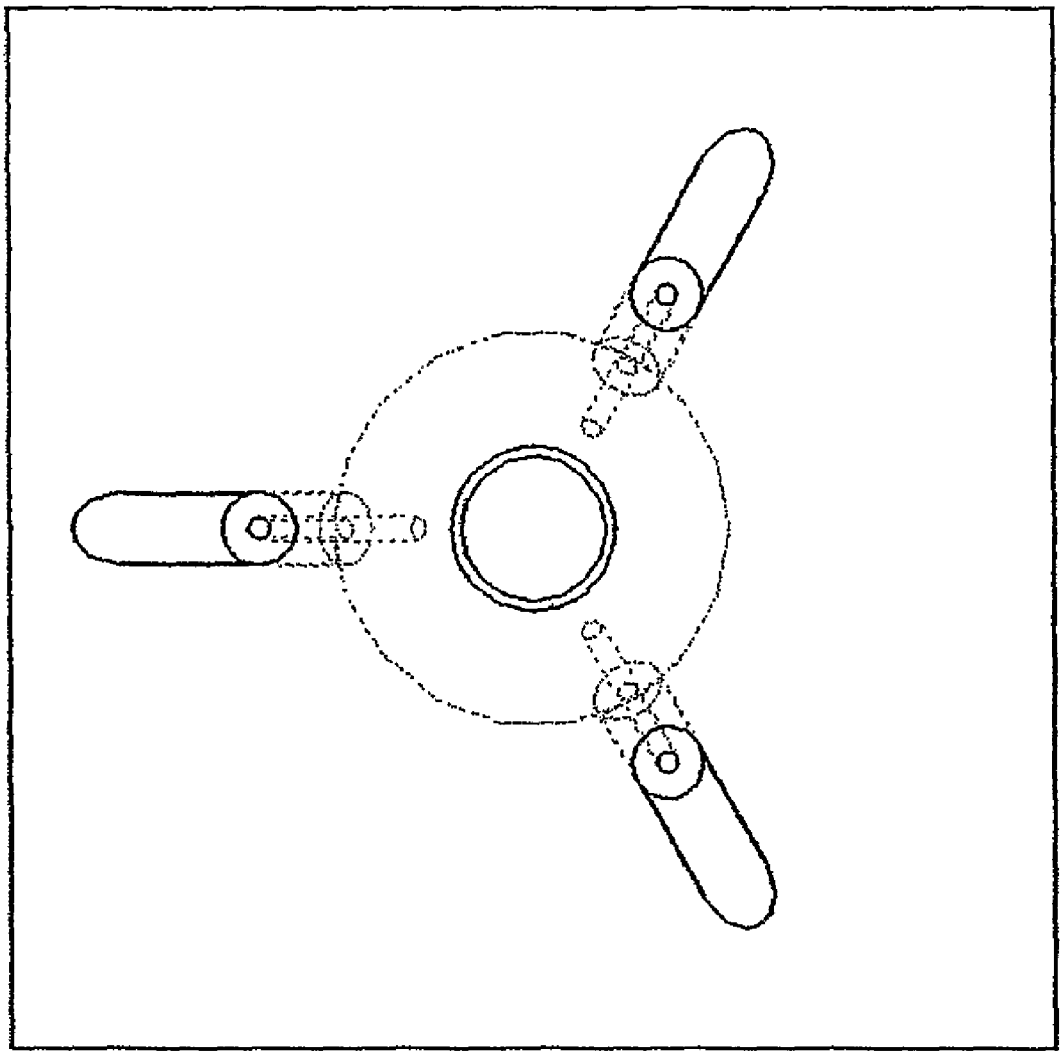
FIG. 22 is a schematic rear view of an embodiment of the transducer with 3 probes, with the planar lower frequency combiner circuits removed for illustrative purpose, thus showing an embodiment of a mechanical inner construction.
Figure 23:
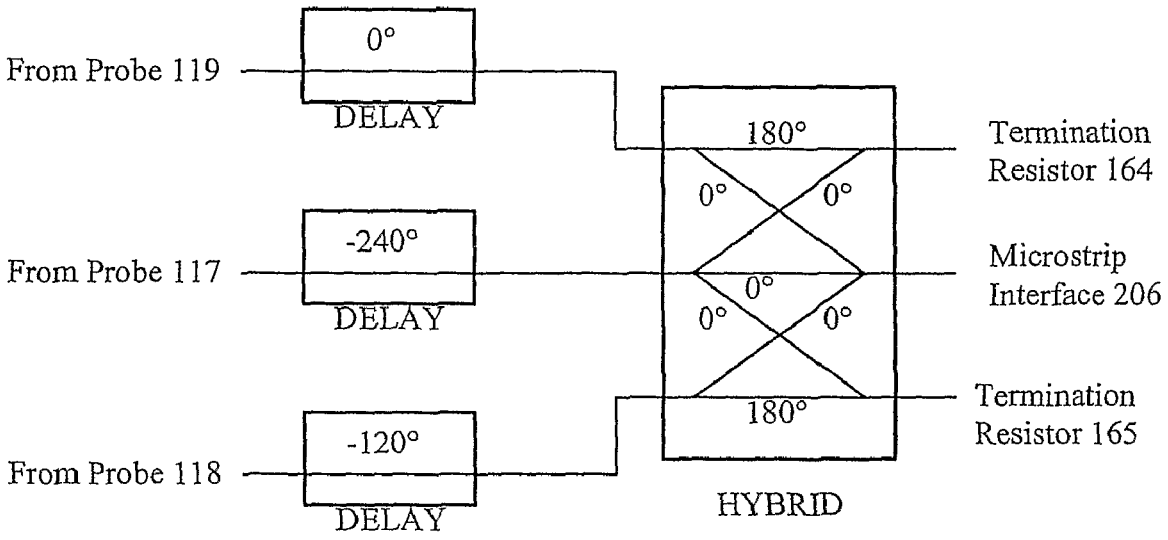
FIG. 23 is a simplified electrical schematic of this embodiment (degree indicators, such as (0°, −120°, 180°, −240°), signify phase offsets between linked elements), including delay circuits which impart the depicted phase offset.

Instead of using four probes under preferably 90° angles (e.g., probes 115, 116, 117, and 119, as shown in FIG. 18) and accordingly designed hybrid or hybrids, the same functionality can be obtained using three probes under preferably 120° angles and an accordingly designed hybrid. This can be done for one or two linear polarization couplings, or for one or two circular polarization couplings. Also, by appropriate design of the hybrid, one or more resistor may be incorporated as to provide some degree of termination of the coaxial waveguide TEM mode. FIG. 20 and FIG. 21 are a schematic front view looking into the coaxial waveguide interface 4 (FIG. 1) and a schematic rear view, respectively, of an embodiment of the transducer using three probes. FIG. 21 shows probes 117, 118, 119, microstrip interface 206, and termination resistors 164 and 165. FIG. 22 is a schematic rear view of this embodiment, with the planar lower frequency combiner circuits removed for illustrative purpose, thus showing an embodiment of a mechanical inner construction. FIG. 23 is a simplified electrical schematic of this embodiment having ports for inputs from probes 117, 118, 119, respectively and output 206 at a microstrip interface, and two termination resistors 164, 165. The circuit has a microstrip interface 206 and connections to termination resistors 164, 165. If only one polarization, either linear or circular, is required, two probes may suffice, while still allowing for some termination of the TEM mode.

In any of the previous embodiments, it is also possible to incorporate amplifiers 300 between the probes and the hybrids, for example, such as depicted in FIGS. 15, 17 and 19, or have them included within the hybrids. This provides an improvement in overall performance.

Figure 10:
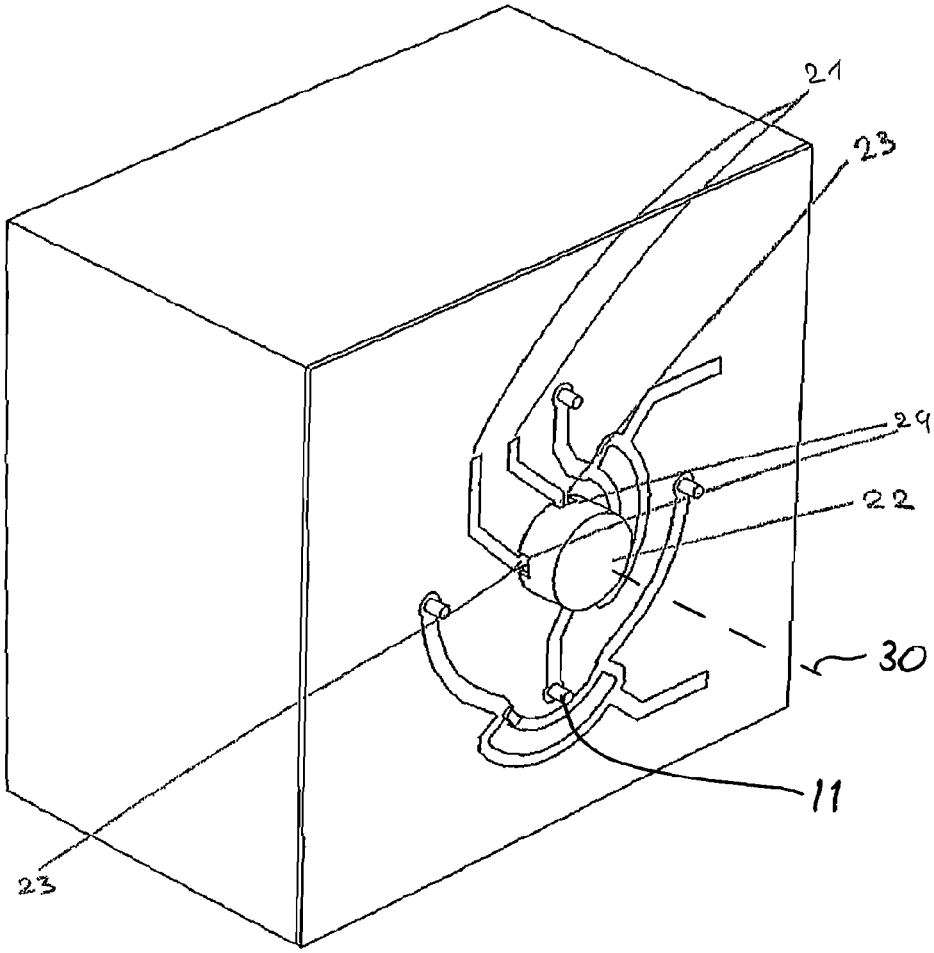
FIG. 10 and FIG. 11 are a schematic perspective view and a schematic longitudinal section view, respectively, of an embodiment of the transducer, showing an embodiment of the continuing higher frequency waveguide with probes on the same planar structure as the lower frequency combiner circuits.
Figure 11:
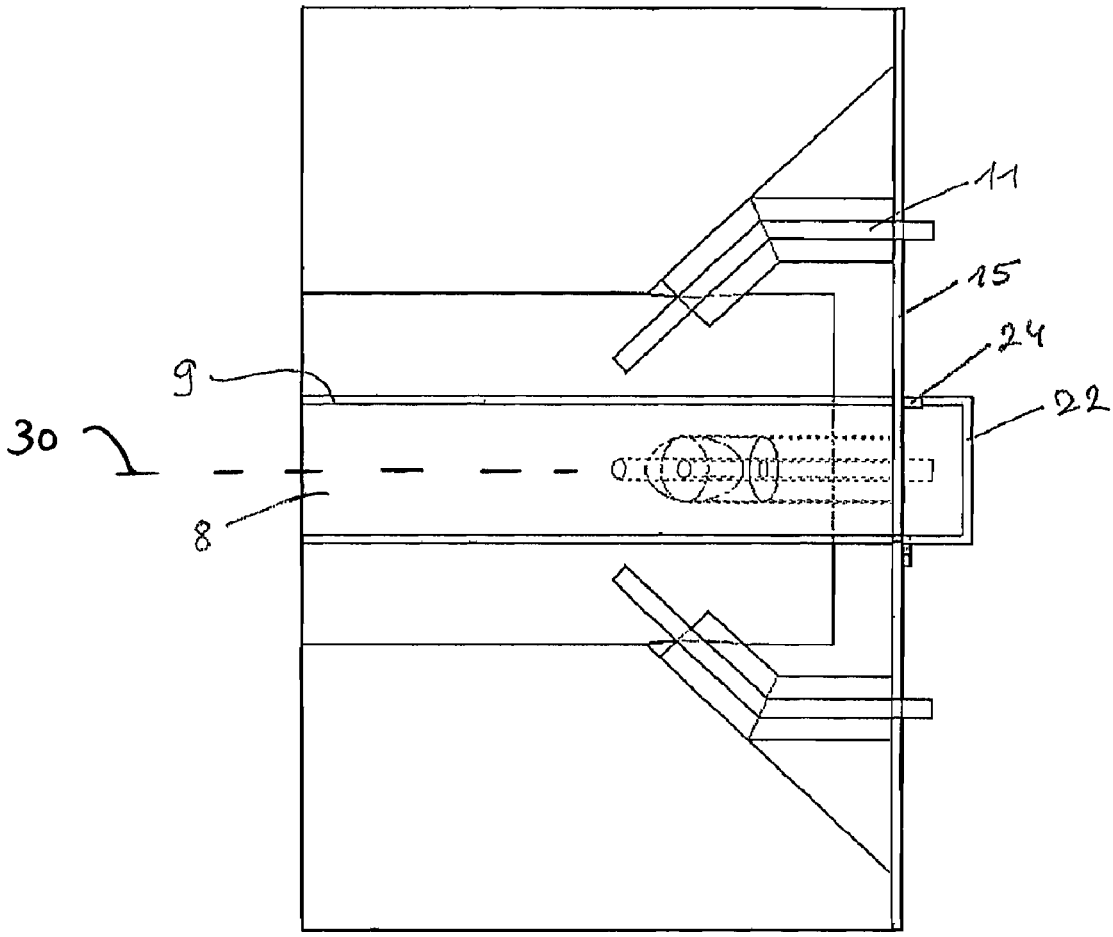
Figure 12:
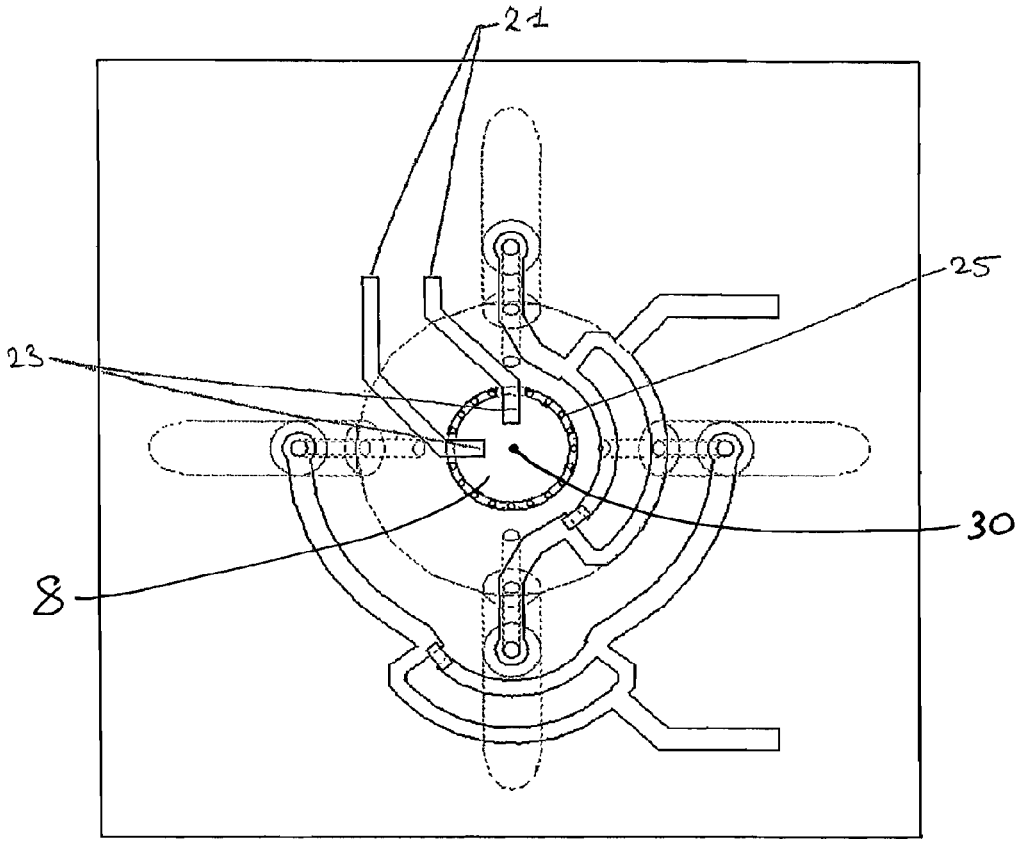
FIG. 12 is a schematic rear view of the same embodiment, but with the waveguide end removed for illustrative purpose.

FIGS. 10-12 show an embodiment of the transducer where the inner, higher frequency, waveguide 8 (FIG. 4) continues within the arrangement of second waveguide probes 11. FIG. 12 shows the waveguide end removed for clarity. It is useful to extend the high frequency waveguide as shown, because the probes can be implemented then on board 15 (FIG. 11) and the impedance can be optimized as explained below. In this embodiment two probes 23 (FIGS. 10, 12) are mounted within the inner waveguide 8 (FIG. 11), offset at 90° from one another.

Probes 23 are mounted on the same planar board 15 as the lower frequency combiner circuits previously described. The waveguide 8 (FIG. 11) is continued through, and beyond, the board 15. This is achieved by a ring of holes 25 (FIG. 12) positioned on the board 15. The holes are metallised in the direction of the longitudinal axis 30 and are connected to one another on the surface of the board 15 by a metallised track. This provides some degree of electrical continuity of the waveguide walls 9 (FIG. 11). The ring of holes 25 aligns with the wall 9 of the inner waveguide 8. A closed end cap 22 (FIGS. 10, 11) fits on the other side of the ring of holes 25. The side wall of the cap 22 (FIGS. 10. 11) has a pair of cut-outs 24 (FIGS. 10, 11) to allow the interface lines 21 (FIGS. 10, 12) to enter the waveguide region enclosed by the cap 22. The cut-outs 24 are spaced from the feeds 21. The probe 23 is formed by metallised tracks on board 15. The later provide a dielectric in the waveguide and also provide mechanical support for the probes. The probe dimensions and their distance to the closed waveguide end 22 preferably are optimized for matching to the microstrip interfaces 21. Even though the probes 23 are in the same plane as the lower frequency range combiner circuits 19, no cross-over bridges are required to access the microstrip interfaces 21 from other circuits placed on the same plane, thus allowing for a straightforward construction suitable for mass manufacturing. Though the probe orientation for the lower and the upper frequency ranges are shown parallel, and therefore the linear polarizations at the lower and higher frequency band are coplanar, other embodiments may have angled orientation between the frequency ranges. That is the planes defined by each probe axis and the waveguide axis are not same for the lower and the higher frequency range. Also, other probe configurations for transition to circular waveguide can be integrated.

If, instead of linear polarization, one or both circular polarization are required, preferably 90°, preferably microstrip, hybrids can be incorporated between the probes and the preferably microstrip interfaces.

In the embodiment described above the inner waveguide 8 is extended by a combination of a ring of metallised holes 25 and an end cap 22. The board 15 lies across the inner waveguide 8. In an alternative embodiment, a hole is provided in board 15 which allows the waveguide tube 9 to pass through the board 15. An end cap fits across the open end of tube 9. Cut-outs are provided in the side wall of tube 9 to allow probes, e.g. soldered to interfaces 21, to enter.

Figure 13:
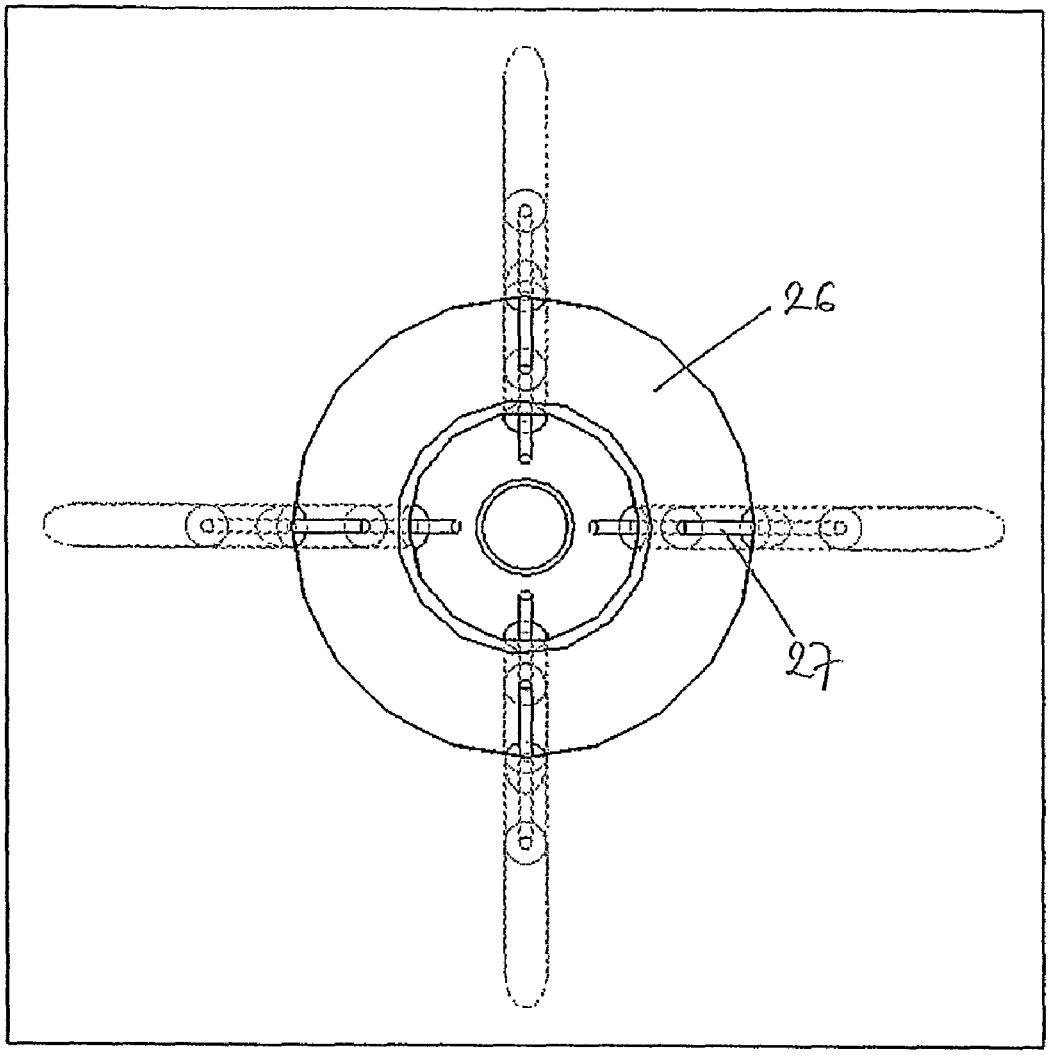
FIG. 13 and FIG. 14 are a schematic front view and a schematic longitudinal section view, respectively, of an embodiment of a tri-band transducer.
Figure 14:
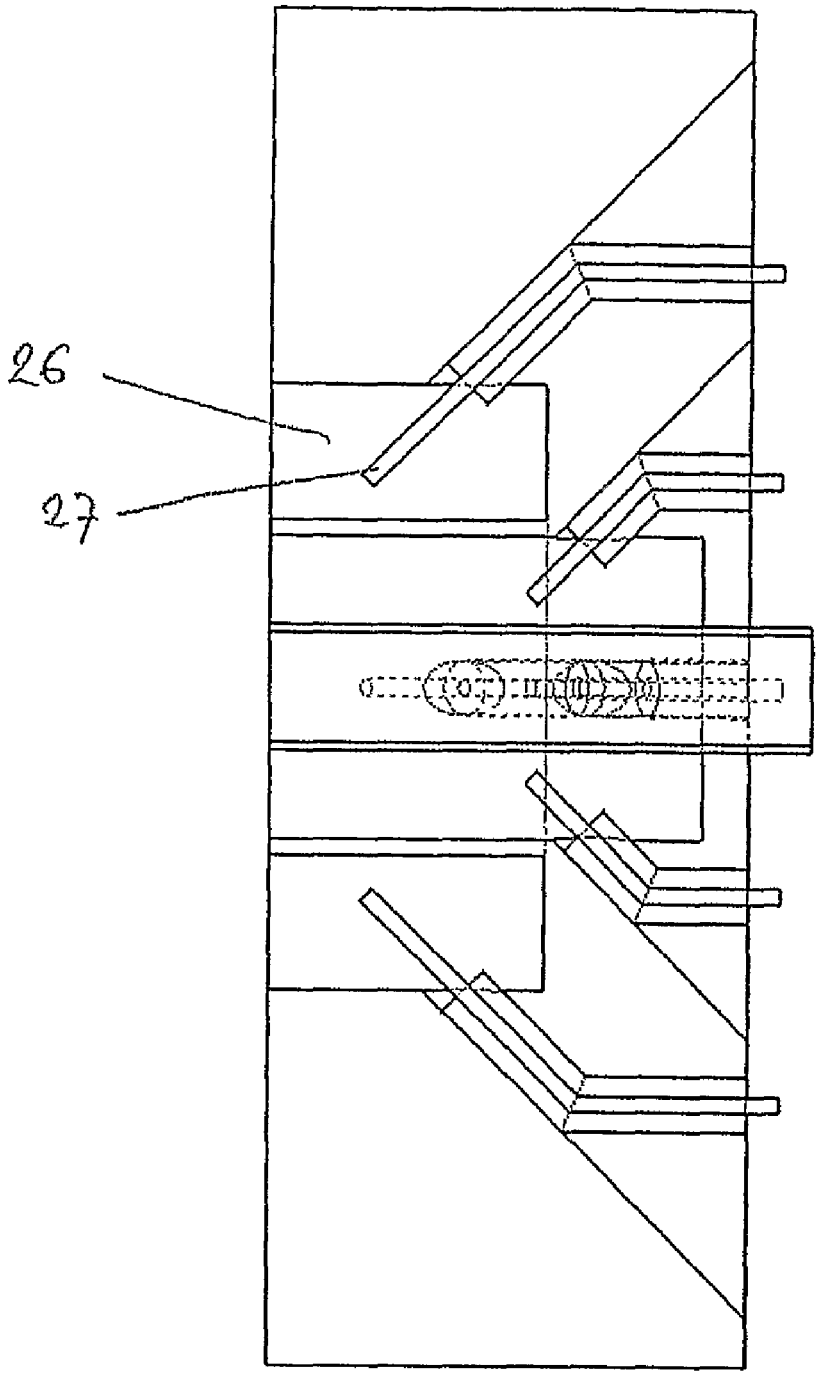
Figure 24:
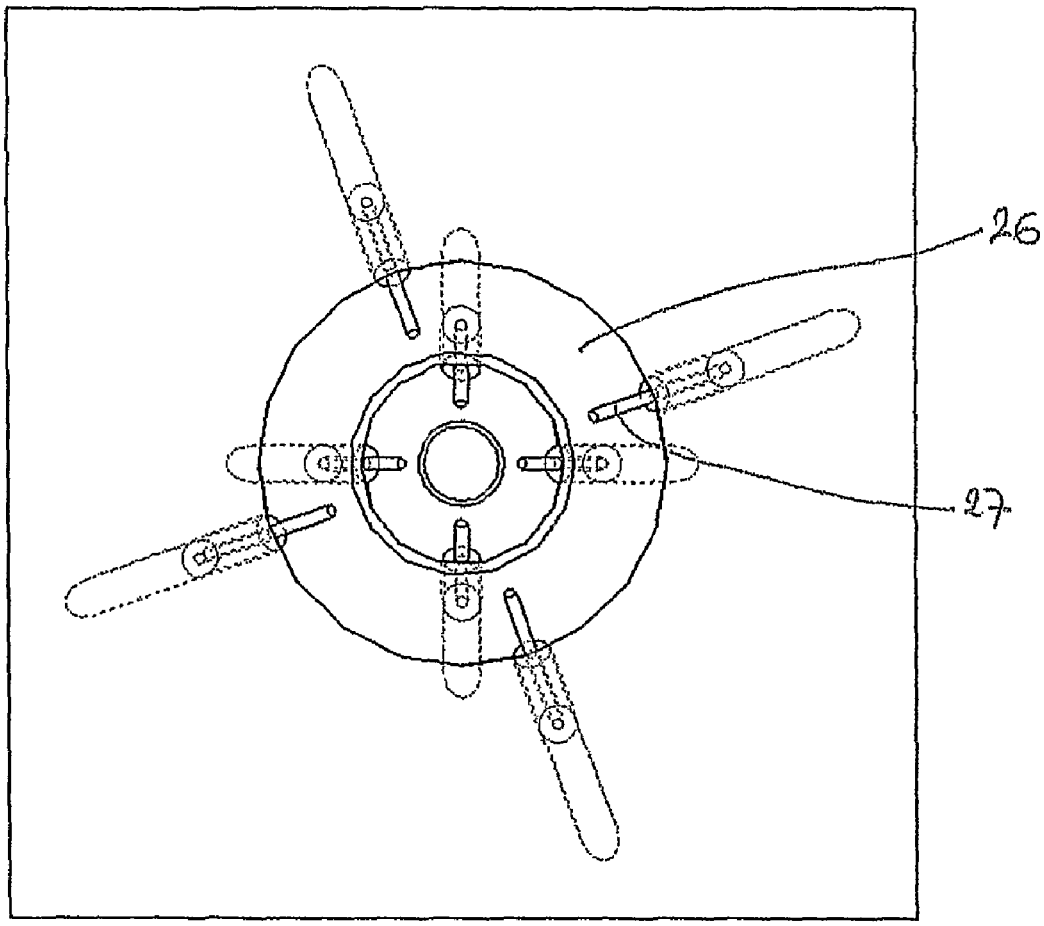
FIG. 24 is a schematic front view of an embodiment of a tri-band transducer with non-coplanar polarizations of the lowest and middle frequency ranges.

FIG. 13 and FIG. 14 are a schematic front view and a schematic longitudinal section view, respectively, of the embodiment of a transducer using the same principles but extended for three band operation. A third waveguide 26 is provided for a third frequency range, e.g. C-band, and probes 27 penetrate into this waveguide. All principles as used in the lower frequency band waveguide of the two-band transducer embodiment described before, can be applied to this third, lowest, frequency range. Though the probe orientation for the second, lower and the third lowest frequency ranges are shown parallel in this embodiment, other embodiments may have angled orientation between these frequency ranges, thus resulting in non-coplanar polarizations for these frequency ranges. FIG. 24 is a schematic front view of an embodiment of such a tri-band transducer with non-coplanar polarizations of the lowest and lower frequency ranges with third waveguide 26 and probes 27.

The invention is not limited to the embodiments described herein, which may be modified or varied without departing from the scope of the invention.

The invention claimed is:

1. A multi-band transducer for an antenna comprising:

a first waveguide which extends along a longitudinal axis;

a second waveguide which is mounted coaxially with, and around, the first waveguide;

a housing which supports the first and second waveguides and which has an end face which is substantially perpendicular to the longitudinal axis of the first and second waveguides; and at least one second waveguide probe which extends between the interior of the second waveguide and the end face of the housing, wherein that the housing has at least one funnel-shaped cavity which extends between a point at which the at least one second waveguide probe enters the interior of the waveguide and the end face of the housing, the at least one second waveguide probe is housed within a respective one of the at least one funnel-shaped cavities within the housing, and the at least one second waveguide probe is a respective bent probe which is inclined with respect to the longitudinal axis of the second waveguide at an end of the probe which enters the interior of the second waveguide, the inclination being towards the end face of the housing.

2. A multi-band transducer according to claim 1, wherein the at least one funnel-shaped cavity has a radially-outermost side which extends between the point at which the at least one second waveguide probe enters the interior of the second waveguide and the end face of the housing and a radially-innermost side which has a first portion which extends parallel to the radially-outermost side from the point at which the second waveguide probe enters interior of the second waveguide and a second portion which extends substantially parallel to the longitudinal axis.

3. A multi-band transducer according to claim 1, further comprising a dielectric member mounted within the second waveguide opposite the position at which the at least one second waveguide probe enters the interior of the second waveguide.

4. A multi-band transducer according to claim 1, further comprising a board mounted to the end face of the housing which electrically connects to the at least one second waveguide probe.

5. A multi-band transducer according to claim 4, wherein the at least one second waveguide probe comprises at least two second waveguide probes and the board electrically connects to the at least two second waveguide probes and further comprises a combining circuit for combining signals derived from the at least two second waveguide probes.

6. A multi-band transducer according to claim 4, wherein the board further comprises a hybrid which provides electrical termination of a TEM mode in the second waveguide.

7. A multi-band transducer according to claim 4, wherein the board further comprises one or more amplifiers.

8. A multi-band transducer according to claim 4, wherein the first waveguide continues through the board.

9. A multi-band transducer according to claim 8, wherein the board comprises a set of metallized holes which align with a wall of the first waveguide and a further waveguide section is mounted to the board, on top of the set of metallized holes.

10. A multi-band transducer according to claim 4, wherein the board also electrically connects to at least one first waveguide probe.

11. A multi-band transducer according to claim 1, further comprising hybrids with suitable phase relations for orthogonal linear polarizations.

12. A multi-band transducer according to claim 1, further comprising hybrids with suitable phase relations for circular polarizations.

13. A multi-band transducer according to claim 1, further comprising a third waveguide which is mounted coaxially with, and around, the first and second waveguides and at least one third waveguide probe which extends between the interior of the third waveguide and the end face of the housing.

14. A multi-band transducer according to claim 1, further comprising at least one first waveguide probe which extends between the interior of the first waveguide and the end face of the housing.

15. A multi-band transducer for an antenna comprising:

a first waveguide which extends along a longitudinal axis;

a second waveguide which is mounted along the longitudinal axis coaxially with, and around, the first waveguide;

a housing which supports the first and second waveguides and which has an end face which is substantially perpendicular to the longitudinal axis of the waveguides; and at least one second waveguide probe which extends between the interior of the second waveguide and the end face of the housing, characterized by there being at least two second waveguide probes, a board mounted to the end face of the housing, the board electrically connecting to the at least two second waveguide probes and further comprising a combining circuit for combining signals derived from the at least two second waveguide probes and a hybrid which provides electrical termination of a TEM mode in the second waveguide.

16. A multi-band transducer according to claim 15, wherein the first waveguide continues through the board.

17. A multi-band transducer according to claim 15, wherein the housing has at least one funnel-shaped cavity which extends between a point at which the at least two second waveguide probes enter the interior of the second waveguide and the end face of the housing.

18. A multi-band transducer according to claim 15, wherein each of the at least two second waveguide probes is housed within a respective channel within the housing.

19. A multi-band microwave transducer according to claim 15, wherein the housing has at least one funnel-shaped cavity which extends between a point at which the at least one second waveguide probe enters the interior of the second waveguide and the end face.

20. A multi-band transducer according to claim 19, wherein the at least one funnel-shaped cavity has a radially-outermost side which extends between the point at which the at least one second waveguide probe enters the interior of the second waveguide and the end face of the housing and a radially-innermost side which has a first portion which extends parallel to the radially-outermost side from the point at which the second waveguide probe enters interior of the second waveguide and a second portion which extends substantially parallel to the longitudinal axis.

21. A multi-band transducer according to claim 15, further comprising a dielectric member mounted within the second waveguide opposite the position at which the second waveguide probe enters the interior of the second waveguide.

22. A multi-band transducer according to claim 15, wherein the board further comprises one or more amplifiers.

23. A multi-band transducer according to claim 15, further comprising hybrids with suitable phase relations for orthogonal linear polarizations.

24. A multi-band transducer according to claim 15, further comprising hybrids with suitable phase relations for circular polarizations.

25. A multi-band transducer according to claim 15, further comprising at least one first waveguide probe which extends between the interior of the first waveguide and the end face of the housing.

26. A multi-band transducer according to claim 25, wherein the at least two second waveguide probes are inclined with respect to the longitudinal axis of the second waveguide at an end of each probe that enters the interior of the second waveguide, the inclination extending towards the end face of the housing.

27. A multi-band transducer according to claim 15, wherein the board comprises a set of metallized holes which align with a wall of the first waveguide and a further waveguide section is mounted to the board, on top of the set of metallized holes.

28. A multi-band transducer according to claim 15, further comprising a third waveguide which is mounted coaxially with, and around, the first and second waveguides and at least one third waveguide probe which extends between the interior of the third waveguide and the end face of the housing.

29. A multi-band transducer according to claim 15, wherein the board also electrically connects to an at least one first waveguide probe.

* * * * *